United States Patent [19]

Amano et al.

[11] 4,336,735

[45] Jun. 29, 1982

[54] ELECTRONIC MUSICAL INSTRUMENT GENERATING SUPPLEMENTARY NOTES AUTOMATICALLY ESTABLISHED FROM PLAYED NOTES

[75] Inventors: Takehisa Amano; Seiya Hamada; Sigeki Isii; Toshio Takeda, all of Hamamatsu, Japan

[73] Assignee: Nippon Gakki Seizo Kabushiki Kaisha, Hamamatsu, Japan

[21] Appl. No.: 216,961

[22] Filed: Dec. 16, 1980

[30] Foreign Application Priority Data

Dec. 17, 1979 [JP] Japan ..... 54/163884

[51] Int. Cl.[3] ..... G10H 1/22

[52] U.S. Cl. ..... 84/1.17; 84/DIG. 22; 307/231; 328/137; 328/154; 340/825.5

[58] Field of Search ..... 84/1.01, 1.03, 1.17, 84/1.24, DIG. 2, DIG. 4, DIG. 22; 307/231; 328/137, 154; 340/147 LP

[56] References Cited

U.S. PATENT DOCUMENTS

| | | | |
|---|---|---|---|
| 4,074,233 | 2/1978 | Swain | 84/1.01 X |
| 4,138,916 | 2/1979 | Kitagawa | 84/1.01 |
| 4,138,917 | 2/1979 | Sakashita et al. | 84/1.01 |
| 4,141,268 | 2/1979 | Kugisawa | 84/1.03 |
| 4,194,425 | 3/1980 | Kitagawa | 84/1.01 |
| 4,204,452 | 5/1980 | Uchiyama | 84/1.01 |
| 4,218,948 | 8/1980 | Nakada et al. | 84/1.01 |
| 4,228,712 | 10/1980 | Uchiyama et al. | 84/1.01 |
| 4,267,762 | 5/1981 | Aoki et al. | 84/1.03 |
| 4,269,102 | 5/1981 | Kondo et al. | 84/1.01 |

FOREIGN PATENT DOCUMENTS 2856043 7/1979 Fed. Rep. of Germany ... 84/DIG. 2

*Primary Examiner*—S. J. Witkowski

*Attorney, Agent, or Firm*—Spensley, Horn, Jubas & Lubitz

[57] ABSTRACT

A three-keyboard electronic musical instrument of the type generating binary-coded primary key data representative of notes played on the keyboards, and secondary key data representative of unplayed notes that are correlated with the played notes in some musically favorable way. Prior to introduction into a multi-channel tone generator circuit, part of the primary key data and all of the secondary key data are directed into a key data memory having storage channels corresponding in number to the sounding channels in the tone generator circuit available for such data. A discrimination data memory has a plurality of storage locations, corresponding to the storage channels of the key data memory, for storing binary-coded data representing the discrimination between the primary and the secondary key data stored on the corresponding storage channels of the key data memory. In response in part to the output from the discrimination data memory a memory control circuit causes the key data memory to store the primary key data in preference to the secondary key data when the key data memory has no empty channel for each incoming data, by invalidating a secondary key data already in storage.

18 Claims, 12 Drawing Figures

HIGHEST UK NOTE DETECTOR 14

141
143
COMPARATOR
A
B
A>B
A≠B
KOI
YU
A1
Y9
A2
IC
OR1
OR2
ΦA,B
CR LD
HIGHEST-UK-NOTE TEMPORARY MEMORY
142
144
KC
ACH
ALKC (AN1~AN4 AB1~AB3)
KC (N1~N4 B1~B3 KOI

LOWEST-UK-NOTE DETECTOR 15

151
153
COMPARATOR
A
B
A<B
A≠B
KO
YU
Y1
Y9
A3
A4
IC
OR3
ΦA,B
CR LD ST
LOWEST-UK-NOTE TEMPORARATOR MEMORY
CR LD
LOWEST-UK-NOTE MEMORY
152
154
KC
ICH
IKC (IN1~IN4 IB1~IB3)
KC (N1~N4 B1~B3 KOI

ELECTRONIC MUSICAL INSTRUMENT GENERATING SUPPLEMENTARY NOTES AUTOMATICALLY ESTABLISHED FROM PLAYED NOTES

BACKGROUND OF THE INVENTION

Our invention relates to electronic musical instruments in general and, in particular, to a polyphonic electronic musical instrument of the type having a plurality of sounding channels for simultaneous production of tones corresponding to notes played on one or more keyboards, as well as notes established (created) automatically in predetermined relationship to the played notes. Still more particularly, our invention concerns such an instrument with facilities for controlling the channeling operation of notes to be sounded, depending upon whether the notes are played ones or automatically established ones.

The electronic musical instrument has been known and used extensively which, in response to the depression of keys on a keyboard or keyboards, generates binary-coded key data representative of the played notes (depressed keys) and which also automatically produces data indicative of unplayed notes having a certain musically acceptable relationship with the played notes, being automatically established as based on the played notes according to the predetermined conditions. We will call the first type of data the "primary key data" (meaning played key data), and the second type of data the "secondary key data" (meaning supplementary key data), to facilitate the subsequent description. The known instrument includes a data memory having several storage channels each for storing one of the generated sets of primary and secondary key data, prior to delivery to a multichannel tone generator circuit for translation into corresponding tones.

A problem arises in this type of instrument from the fact that the storage channels of the data memory are usually considerably less in number than the keys of the instrument. Should a set of primary or secondary key data be generated when all the storge channels are occupied, either of the data sets in storage must be canceled or invalidated. In such cases it is desirable that a set of secondary, rather than primary, key data be canceled to empty one of the storage channels for the reception of the new data set. Such preferential cancellation of secondary key data has not been possible heretofore. This is because, once the key data have been assigned to the storage channels of the data memory, the conventional instrument has not been equipped to distinguish between the primary and the secondary key data.

In order to better illustrate the above problem, there may be considered an electronic musical instrument which generates, as the secondary key data, those representative of notes having a predetermined octaval relation with notes played on the upper keyboard, and/or of notes that are of the same names as those played on the lower keyboard but which are more intimately associated octavally with notes played on the upper keyboard. Such secondary key data are stored in the data memory along with primary key data representative of notes played on the upper keyboard. Subsequently processed into tone signals by the tone generator circuit, the primary and secondary key data are sounded together via an audio output system.

Let it be assumed that, in the instrument of this type, the performer has depressed a key on the upper keyboard when all the storage channels of the data memory are filled with the primary and secondary key data. As will be apparent from the foregoing, the notes represented by the secondary key data are of an accessory (supplementary) character with respect to the notes played on the upper keyboard. Thus, in emptying one of the storage channels for the newly generated set of primary key data, a set of secondary, rather than primary, key data in storage should be canceled to cut short the production of the corresponding tone. The attainment of this objective calls for the provision of means for discriminating whether the data set on each channel of the data memory is primary or secondary.

SUMMARY OF THE INVENTION

In view of the above state of the art we seek to make it possible to identify the key data in channeled storage as being either primary or secondary and hence to differently control the channeling, and invalidating, operation of the primary and secondry key data. More specifically, through accomplishment of the first recited object, we seek to give priority to the primary key data over the secondary in assigning them to the storage channels of the data memory, in order that played notes may be sounded in preference to unplayed, automatically created supplementary notes.

According to our invention, stated in brief, a polyphonic, keyboard-type electronic musical instrument is provided which includes first memory (referred to as the data memory in the description of the prior art) having a plurality of storage channels for storing a corresponding number of sets of primary and secondary key data prior to delivery to multichannel tone generator means. Also included are second memory means having a plurality of storage locations, corresponding one to each storage channel of the first memory means, for storing data identificatory of the primary or secondary key data stored in the corresonding storage channels of the first memory means. The output from the second memory means can be utilized as desired to control the assignment of the key data to, and their cancellation from, the storage channels of the first memory means.

In a preferred embodiment the output from the second memory means is used by a memory control circuit to cause the first memory means to accept and store the primary key data in preference to the secondary. If a set of primary key data is generated when all the storage channels are occupied, the memory control circuit coacts with the second memory means to invalidate a set of secondary key data that has been in storage in the first memory means. It is possible in this manner to sound the played note represented by the new primary key data set by cutting short the tone production of the unplayed (supplementary) note corresponding to the invalidated secondary key data set.

The above and other objects, features and advantages of our invention and the manner of attaining them will become more apparent, and the invention itself will best be understood, from the following description of the preferred embodiment taken in connection with the attached drawings.

DESCRIPTION OF THE PREFERRED EMBODIMENT

General

Figure 1:
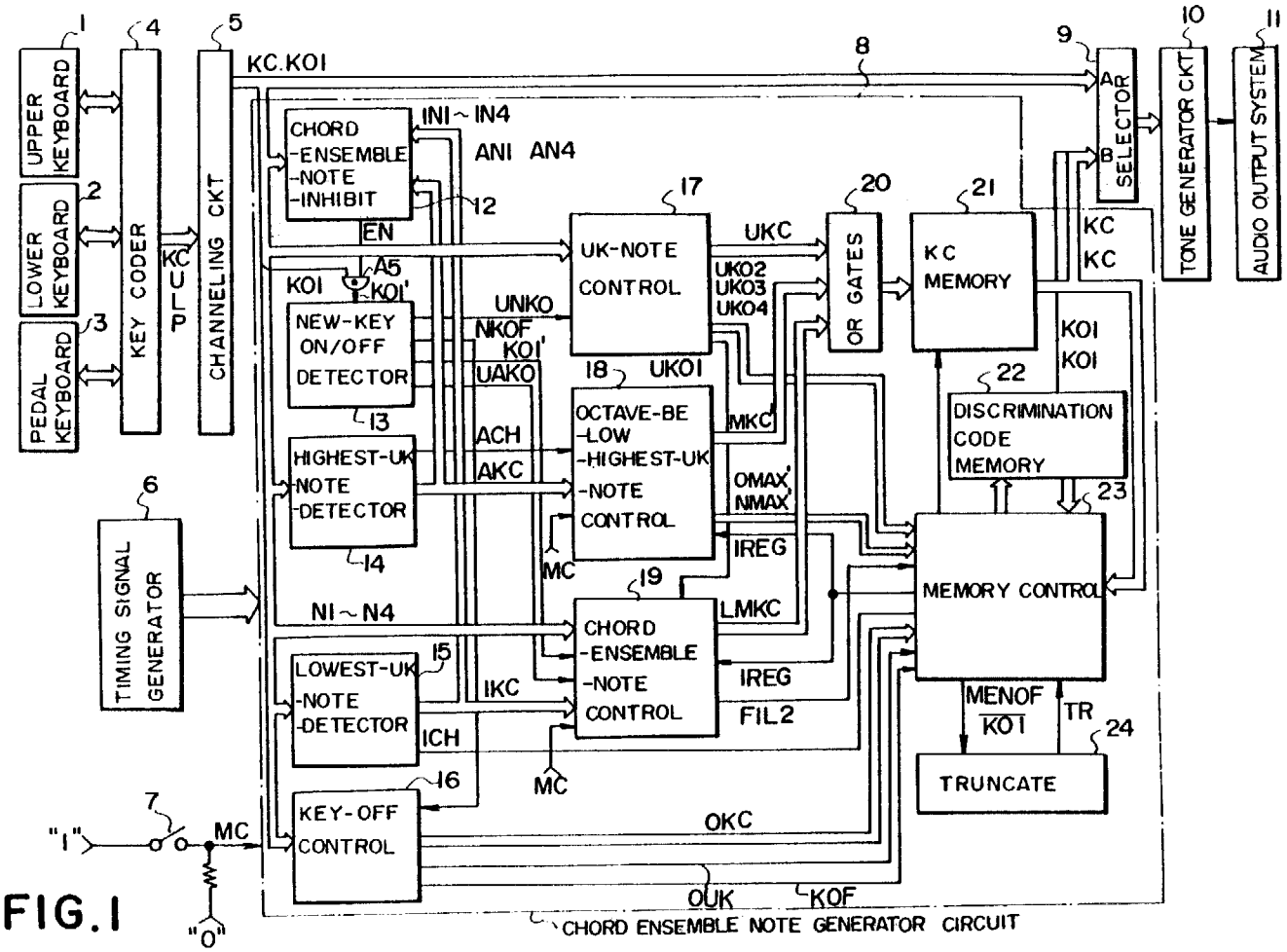
FIG. 1 is a block diagram of the electronic musical instrument incorporating the novel concepts of our invention.

We will now describe our invention as adapted specifically for a three-keyboard electronic musical instrument generally known as an electronic organ. As shown in block diagrammatic form in FIG. 1, the exemplified instrument has an upper keyboard or manual 1, a lower keyboard or manual 2, and a pedal keyboard or clavier 3. In direct functional association with the three keyboards 1, 2 and 3 is a key coder or keying detector 4 which detects the keys played on the keyboards and which generates and puts out key data KC in accordance with a prescribed binary "key code", together with binary keyboard signals U, L and P.

The key code for use in the practice of our invention resolves itself into a four-bit note code (with bits N1, N2, N3 and N4) and a three-bit octave code (with bits B1, B2 and B3), so that the key-coded key data KC are of seven-bit format. The note code identifies the note name of each depressed key, whereas the octave code indicates the octave to which the depressed key belongs. The keyboard including the depressed key is to be represented by the corresponding one of the three keyboard signals U, L and P.

Table 1 below represents an example of the note code.

TABLE 1

| Note Names | NOTE CODE N4 | N3 | N2 | N1 |
|---|---|---|---|---|
| C# | 0 | 0 | 0 | 1 |
| D | 0 | 0 | 1 | 0 |
| D# | 0 | 0 | 1 | 1 |
| E | 0 | 1 | 0 | 1 |
| F | 0 | 1 | 1 | 0 |
| F# | 0 | 1 | 1 | 1 |
| G | 1 | 0 | 0 | 1 |
| G# | 1 | 0 | 1 | 0 |
| A | 1 | 0 | 1 | 1 |
| A# | 1 | 1 | 0 | 1 |
| B | 1 | 1 | 1 | 0 |
| C | 1 | 1 | 1 | 1 |

The following Table 2 lists an example of the octave code.

TABLE 2

| Octaves | OCTAVE CODE B3 | B2 | B1 |
|---|---|---|---|
| 1 | 0 | 0 | 0 |
| 2 | 0 | 0 | 1 |
| 3 | 0 | 1 | 0 |
| 4 | 0 | 1 | 1 |
| 5 | 1 | 0 | 0 |

Tabulated in Table 3 below are the relations between the three keyboards 1, 2 and 3 and the corresponding states of the keyboard signals U, L and P.

TABLE 3

| Keyboards | KEYBOARD SIGNALS U | L | P |
|---|---|---|---|
| Upper | 1 | 0 | 0 |
| Lower | 0 | 1 | 0 |
| Pedal | 0 | 0 | 1 |

Although not specifically illustrated, the key coder 4 has provision for generating key-coded data for the automatic production of bass and chord accompaniments, in response to the depression of keys on the lower keyboard 2 and pedal keyboard 3. For the convenience of description, however, we will deal with the key-coded data for such automatic bass and chord performance just as we do with the key data representative of keys played actually.

The key coder 4 with such functional features can be of the configuration disclosed in N. Tomisawa U.S. Pat. No. 4,148,017 entitled "DEVICE FOR DETECTING A KEY SWITCH OPERATION" and dated Apr. 3, 1979, or in Y. Uchiyama et al. U.S. Pat. No. 4,228,712 entitled "KEY CODE DATA GENERATOR" and dated Oct. 21, 1980, both assigned to the assignee of the instant application.

The electronic musical instrument now under consideration is polyphonic, being capable of sounding a plurality of notes simultaneously, by allotting such notes to different sounding channels. The total number of sounding channels available in this particular instrument is 16, consisting of seven for the notes of the upper keyboard 1, another seven for the notes of the lower keyboard 2, one for the notes of the pedal keyboard 3, plus a spare one to be explained presently. Connected downstream of the key coder 4, a channeling circuit 5 functions to assign each incoming set of key data KC to either of such divisions of the sounding channels as dictated by the keyboard signals U, L or P and to store the channeled key data in corresponding storage locations. The channeling circuit 5 puts out the channeled key data KC in a time-division multiplexing mode to be detailed later with reference to FIG. 2.

Another function of the channeling circuit 5 is the production, in response to the outputs from the key coder 4, of a key-on signal KO1 indicative of whether the key corresponding to each set of channeled key data KC is being depressed or not. The channeling circuit 5 time-divisionally puts out the key-on signal KO1 along with the channeled key data. The key-on signal KO1 assumes a logical "1" state during the depression of a key and becomes "0" upon release of the key.

For further details concerning the construction and operation of this channeling circuit 5, reference is directed to E. Yamaga et al. U.S. Pat. No. 4,192,211, under the title of "ELECTRONIC MUSICAL INSTRUMENT", dated Mar. 11, 1980, and assigned to the assignee of the present application. This patent discloses a similar channeling circuit.

Figure 2:
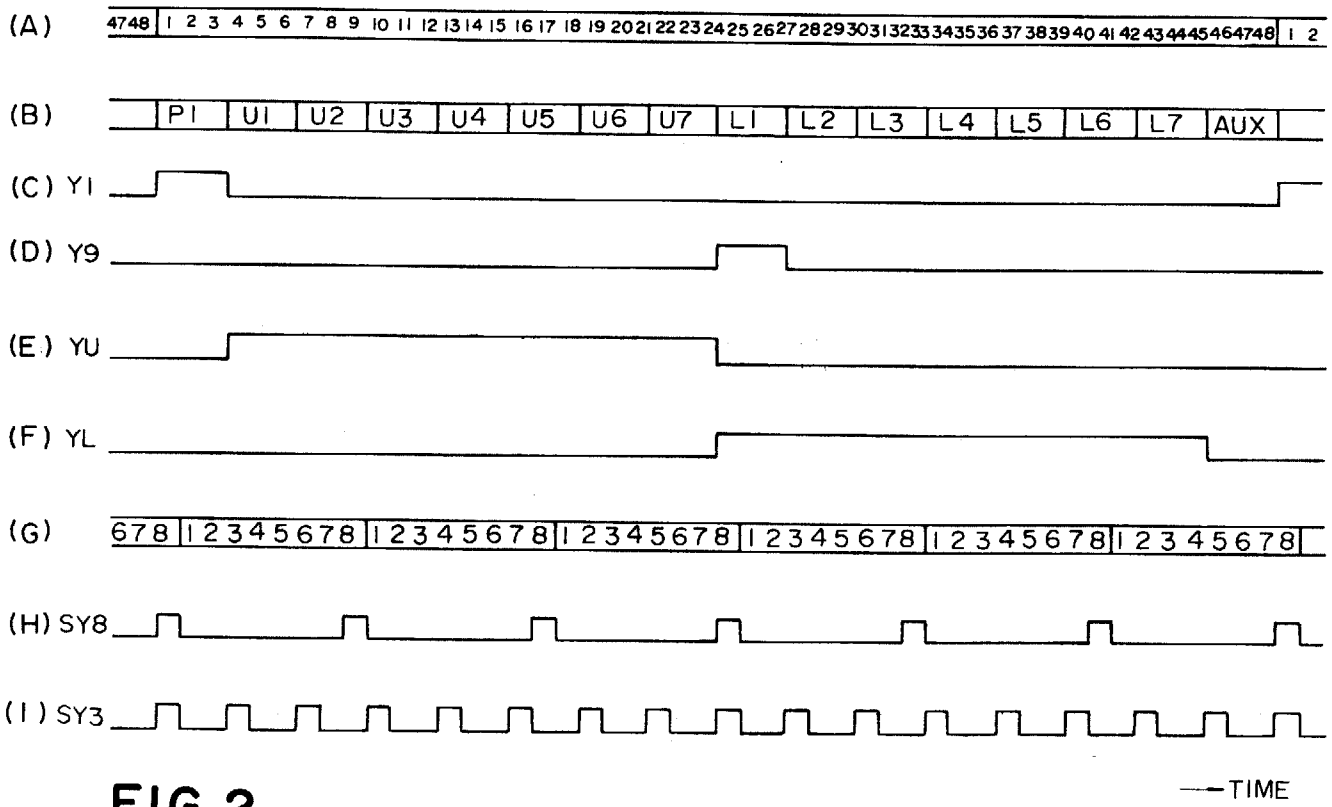
FIG. 2, (A) through (I), is a chart of waveforms and time-divisional channels useful for explaining the operation of the instrument of FIG. 1.

How the channeling circuit 5 time-divisionally puts out the channeled key data KC and key-on signal KO1 will become apparent from a study of FIG. 2. At (A) in FIG. 2 are shown successive "time slots" providing a time basis for the operation of this instrument. Each time slot is one microsecond (μs) long. It takes 48 time slots, or 48 μs, for the channeling circuit 5 to produce the output information (meaning both key data KC and key-on signal KO1) assigned to all the available sounding channels.

Given at (B) in FIG. 2 is a recurrent series of time-divisional channels during which the channeling circuit 5 produces the output information assigned to the complete set of sounding channels. P1 indicates the time-divisional channel for the production of the information representative of a key depressed on the pedal keyboard 3 and assigned to the sounding channel for the pedal keyboard. U1 through U7 denote the time-divisional channels for the production of the information representative of keys played on the upper keyboard 1 and assigned to the seven sounding channels for the upper keyboard. L1 through L7 represent the time-divisional channels for the production of the information representative of keys played on the lower keyboard 2 and assigned to the seven sounding channels for the lower keyboard. Labeled AUX is an additional time-divisional channel for use, for example, in automatic arpeggio performance.

A comparison of (A) and (B) in FIG. 2 will reveal that each time-divisional channel has a duration equal to three time slots. As we have mentioned, therefore, the channeling circuit 5 time-divisionally puts out the complete channeled information KC and KO1 in 48 time slots (μs).

With reference back to FIG. 1 the channeled output information KC and KO1 from the channeling circuit 5 enters a chord ensemble note generator circuit 8 on one hand and, on the other hand, a selector 9 through its first input A. In response to the input information KC and KO1 the chord ensemble note generator circuit 8 creates or establishes key-code data KC* (together with a key-on signal KO1* associated therewith) representative of: (1) notes that are in predetermined octaval relation with notes played on the upper keyboard 1; and (2) notes that are of the same names as those played on the lower keyboard 2 but which are in a tonal region more closely associated with those of notes played on the upper keyboard. We will refer to all such notes represented by the established key-code data KC* as "supplementary notes" and will further specifically refer to the second mentioned notes as "chord ensemble notes". The chord ensemble note generator circuit 8 puts out the supplementary-note key-code data KC* and the associated key-on signal KO1*, together with the key-code data KC representative of the notes of the keys actually played on the upper keyboard 1 (hereinafter referred to as the uk key-code data) and the key-on signal KO1 corresponding thereto. All these outputs from the chord ensemble note generator circuit 8 enter the selector 9 through its second input B.

The selector 9 permits the passage therethrough of the outputs KC and KO1 from the channeling circuit 5 during the time-divisional channels P1 and L1 through L7 for the pedal and lower keyboards. During the time-divisional channels U1 through U7 for the upper keyboard, on the other hand, the selector 9 allows the passage therethrough of the outputs KC, KC*, KO1 and KO1* from the chord ensemble note generator circuit 8.

Connected next to the selector 9 is a multichannel tone generator circuit 10 having 16 sounding channels corresponding to the 16 time-divisional channels P1, U1 through U7, L1 through L7, and AUX of FIG. 2. The key-code data KC and KC* together with the corresponding key-on signals KO1 and KO1* are translated into tone signals through the sounding channels to which they have been assigned. The tone signals travel from the tone generator circuit 10 to an audio output system 11 and are thereby emanated into the air as audible sound.

Chord Ensemble Note Generator Circuit

The chord ensemble note generator circuit 8 receives as aforesaid the key-code data KC representative of played notes, and the key-on signal KO1, from the channeling circuit 5. In response to these inputs the chord ensemble note generator circuit 8 generates the supplementary note key-code data KC* and key-on signal KO1*. The key-code data KC* represents, at each time during performance progression, a note that bears the same name as the highest note played on the upper keyboard but which is an octave below the highest note, and the notes that are of the same names as those played on the lower keyboard but which are in the region close to the lowest note played on the upper keyboard. As has also been mentioned, the chord ensemble note generator circuit 8 puts out not only the supplementary note key-code data KC* and key-on signal KO1* but also the uk key-code data KC and key-on signal KO1 corresponding thereto.

A timing signal generator 6 provides two-level timing signals Y1, Y9, YU, YL and SY8 for controlling the operation of the chord ensemble note generator circuit 8. FIG. 2 represents the timing signals at (C), (D), (E), (F) and (H). We will refer to these timing signals where appropriate in the course of the following description of the chord ensemble note generator circuit 8.

Shown at 7 is a chord ensemble selector switch for application of a two-level chord ensemble instruction signal MC to the chord ensemble note generator circuit 8. When this switch 7 is open as shown, the chord ensemble signal MC is "0", with the result that the chord ensemble note generator circuit 8 passes the uk key-code data KC and key-on signal KO1 without processing them in any way. The following discussion of the chord ensemble note generator circuit 8 presupposes the closure of the switch 7 and, therefore, the "1" state of the chord ensemble signal MC.

Time-divisionally produced by the channeling circuit 5, the channeled information KC and KO1 enters a highest-uk-note detector circuit 14 and a lowest-uk-note detector circuit 15. The key-code data KC of the output information from the channeling circuit 5 are further directed into a key-off control circuit 16 and an uk-note control circuit 17. Still further a note-code data N1–N4 (four bits) included in the key-code data KC are introduced into a chord ensemble note inhibit circuit 12 and a chord ensemble note control circuit 19.

Figure 3:
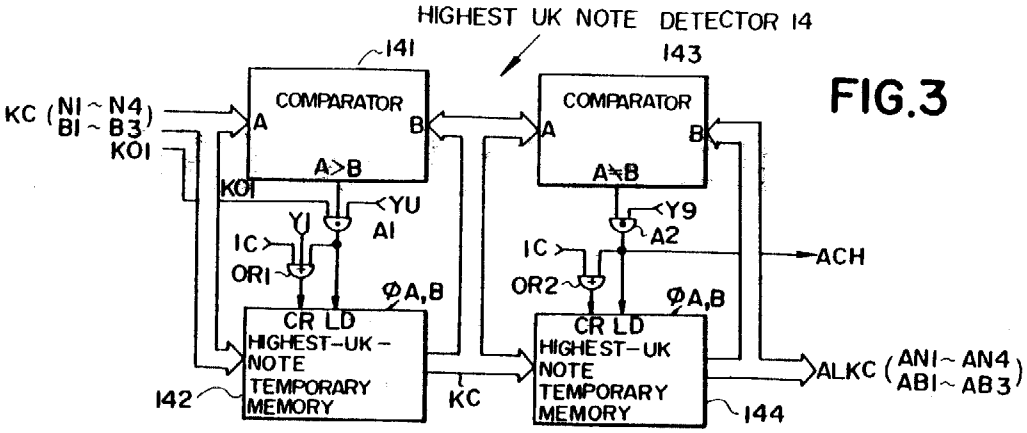
FIG. 3 is a partly block and partly schematic diagram showing in detail the highest-upper-key-note detector circuit (hereinafter "upper-key" being referred to as "uk") in the instrument of FIG. 1.

FIG. 3 shows an exemplary configuration of the highest-uk-note detector circuit 14, which functions to detect the highest of the notes played concurrently on the upper keyboard 1. The channeled key data KC (consisting of the four-bit note-code data N1–N4 and the three-bit octave-code data B1–B3) from the channeling circuit 5 enter a comparator circuit 141, through its first input A, and a highest-uk-note temporary memory 142. The key-on signal KO1 accompanying the key-code data KC is directed into a three-input AND gate A1. Also fed into the comparator circuit 141, through its second input B, is the output from the highest-uk-note temporary memory 142. The comparator circuit 141 applies a "1" to the AND gate A1 when each set of key-code data KC from the channeling circuit 5 is greater than the output from the temporary memory 142. .

The temporary memory 142 has a reset terminal CR coupled to the output of a three-input OR gate OR1. This OR gate inputs: (1) an "initial clear" signal IC; (2) the timing signal Y1 from the timing signal generator 6; and (3) the output from the AND gate A1. By the "initial clear" signal is meant a signal that acquires a "1" state only when the power switch, not shown, of this instrument is closed. As will be seen by referring back to (C) in FIG. 2, the timing signal Y1 is "1" only during each pedal keyboard channel P1 which precedes one sequence of upper keyboard channels U1 through U7. Thus the OR gate OR1 functions to clear the temporary memory 142 both upon closure of the unshown power switch and at the time of each pedal keyboard channel P1. Upon clearing of the temporary memory 142 the subsequent input A to the comparator circuit 141 is of course greater than its input B, so that this comparator circuit delivers a "1" to the AND gate A1.

Fed to the third input of the AND gate A1 is the timing signal YU from the timing signal generator 6. As depicted at (E), FIG. 2, the timing signal YU remains "1" throughout each sequence of upper keyboard channels U1 through U7. Consequently the AND gate A1 produces a "1" when the channeling circuit 5 puts out the first set of uk key-code data KC, accompanied by the key-on signal KO1 of a "1" state, during each sequence of upper keyboard channels U1 through U7. The AND gate A1 impresses this "1" to the load terminal LD of the temporary memory 142 and, via the OR gate OR1, to its reset terminal CR. It is thus seen that the temporary memory 142 admits and temporarily stores the first incoming set of uk key-code data KC.

The comparator circuit 141 compares each of the successively incoming sets of uk key-code data KC with that stored in the temporary memory 142. The output from the comparator circuit 141 becomes "1" when any of uk key-code data KC applied to its input A represents a note higher than that of the uk key code data stored in the temporary memory 142. The comparator circuit 141 applies the "1" output to the load terminal LD of the temporary memory 142 via the AND gate A1 and also to its reset terminal CR via the AND gate A1 and OR gate OR1, whereupon the temporary memory deletes the existing uk key code data and accepts and stores the new data representative of the still higher note.

The output from the comparator circuit 141 remains "0" if each new uk key-code data KC incoming through its input A represents a note lower than that of the data stored in the temporary memory 142. The temporary memory does not respond to the "0" output from the comparator circuit 141, holding the uk key code data already stored therein.

Such data comparison by the comparator circuit 141 and, where necessary, the rewriting of data in the temporary memory 142 are repeated in the course of each sequence of upper keyboard channels U1 through U7. Thus, at the end of each such sequence, the temporary memory 142 stores the data representative of the highest note one of the keys held on the upper keyboard.

The key-code output data KC from the temporary memory 142, representative of the highest one of the concurrently depressed upper keys, are directed into another comparator circuit 143, through its first input A, and into a highest-uk-note memory 144, both included in the highest-uk-note detector circuit 14. Also receiving the output from the memory 144 through its second input B, the comparator circuit 143 compares the two inputs A and B and produces a "1" when the highest-uk-note data from the temporary memory 142 differs from that stored in the memory 144. This "1" output from the comparator circuit 143 enters an AND gate A2 through its first input, the second input of which receives the timing signal Y9 from the timing signal generator 6.

As seen at (D) in FIG. 2, the timing signal Y9 is "1" during the first L1 of the lower keyboard channels L1 through L7, which immediately follows each sequence of upper keyboard channels U1 through U7. Consequently, in the event of a change from one highest played uk key to another, the AND gate A2 produces a "1" in synchronism with the "1" state of the timing signal Y9, for delivery to the load terminal LD of the memory 144 and, via an OR gate OR2, to its reset terminal CR. Thereupon the memory 144 deletes the existing one of highest-uk-key-note data and accepts and stores a new, different data. The reset terminal CR of the memory 144 also receives the noted "initial clear" signal IC via the OR gate OR2, so that the memory is cleared upon closure of the unshown power switch.

It will be clear from the foregoing that the memory 144 of the highest-uk-note detector circuit 14 stores the key-code data KC that represents the highest uk depressed key from moment to moment. We will hereinafter refer to the output data from this memory 144 as the highest-uk-note data AKC (with four-bit note-code data AN1–AN4 and three-bit octave-code data AB1–AB3). We will also call the output from the AND gate A2 a highest-uk-note change signal ACH, which is utilized for a purpose to be explained presently.

Figure 4:
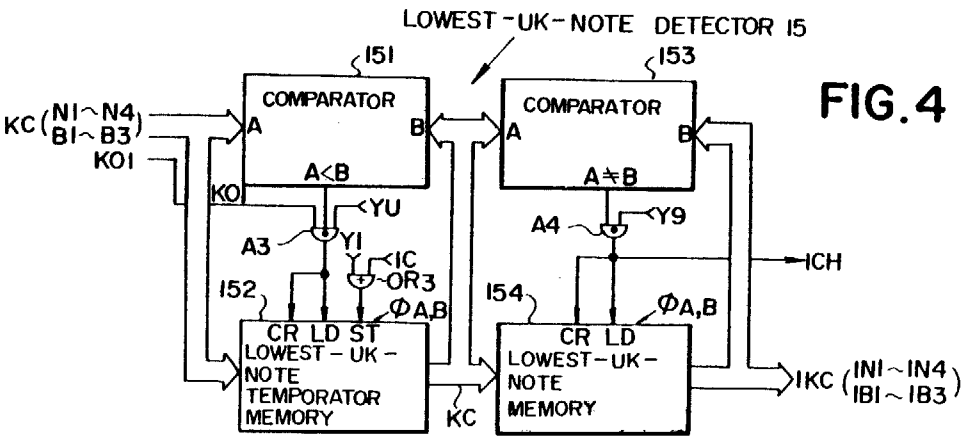
FIG. 4 is a similar diagram showing in detail the lowest-uk-note detector circuit in the instrument of FIG. 1.

FIG. 4 is a block diagram of the lowest-uk-note detector circuit 15, which operates to detect the lowest of the notes played together on the upper keyboard. The lowest-uk-note detector circuit 15 is analogous in configuration with the highest-uk-note detector circuit 14. In this detector circuit 15, however, a comparator circuit 151 (corresponding to the comparator circuit 141 in the detector circuit 14) produces a "1" when each of the key-code data KC from the channeling circuit 5, FIG. 1, is smaller than the data from a lowest-uk-note temporary memory 152 (correspondingly to the temporary memory 142 in the detector circuit 14). Another difference is that the temporary memory 152 has an "initial clear" signal IC and timing signal Y1 applied to its set terminal ST via an OR gate OR3. Accordingly, upon closure of the unshown power switch and prior to each sequence of upper keyboard channels U1 through U7, all the bit locations in the temporary memory 152 are set with "1's".

Referring more specifically to FIG. 4, it will be noted that the channeled key data KC (with the note-code data N1–N4 and octave-code data B1–B3) from the channeling circuit 5 enter both the comparator circuit 151, through its first input A, and the lowest-uk-note temporary memory 152. The comparator circuit 151 compares the first uk key-code data KC incoming through its first input A, with the data applied to its second input B from the temporary memory 152. The first uk key data KC is of course smaller than the output data set from the temporary memory 152, because the latter is of all "1's" as aforesaid, so that the comparator circuit 151 applies a "1" to a three-input AND gate A3.

Delivered to the other two inputs of the AND gate A3 are the key-on signal KO1 from the channeling circuit 5 and the timing signal YU from the timing signal generator 6. Thus the AND gate A3 puts out a "1" at the time of appearance of the first uk key data KC and of the first "1" state of the key-on signal KO1 during each sequence of upper keyboard channels U1 through U7. The "1" output from the AND gate A3 enters both the load terminal LD and reset terminal CR of the temporary memory 152, thereby causing same to admit and store the first uk key data KC from the channeling circuit 5.

The comparator circuit 151 compares each of the succeeding uk key data sets KC from the channeling circuit 5 with the one stored in the temporary memory 152. Whenever each new uk key data represents a note lower than that represented by the data stored in the temporary memory 152, the comparator circuit 151 delivers a "1" to the load LD and reset CR terminals of the temporary memory 152 to rewrite the data stored therein. The comparator circuit 151 allows the temporary memory 152 to retain the existing data when each new upper-key data represents a higher note. Thus, at the end of each sequence of upper keyboard channels U1 through U7, or upon termination of each "1" state of the timing signal YU, the temporary memory 152 stores the key-coaded data set KC indicative of the lowest of notes played on the upper keyboard.

The key-coded output data KC from the temporary memory 152, representative of the lowest one of the concurrently depressed uk keys, are directed into another comparator circuit 153, through its first input A, and into a lowest-uk-note memory 154, both included in the lowest-uk-note detector circuit 15. Receiving the output from the memory 154 through its second input B, the comparator circuit 153 puts out a "1" when a lowest-uk-note data from the temporary memory 152 differs from that stored in the memory 154.

The "1" output from the comparator circuit 153 enters an AND gate A4 through its first input, the second input of which receives the timing signal Y9, (D), FIG. 2. Thus, when both inputs to the AND gate A4 become "1" after each sequence of upper keyboard channels U1 through U7, this AND gate applies a "1" to the load terminal LD and reset terminal CR of the memory 154 thereby causing same to accept and store the new, different lowest-uk-note data.

It is therefore apparent that the memory 154 of the lowest uk-note detector circuit 15 stores the key-code data KC representative of the lowest uk depressed key from moment to moment. The memory 154 puts out the data as the desired lowest uk note data IKC (consisting of four-bit note-code data IN1–IN4 and three-bit octave-code data IB1–IB3). The detector circuit 15 provides another output from the AND gate A4, as a lowest-uk-note-change signal ICH.

Figure 5:
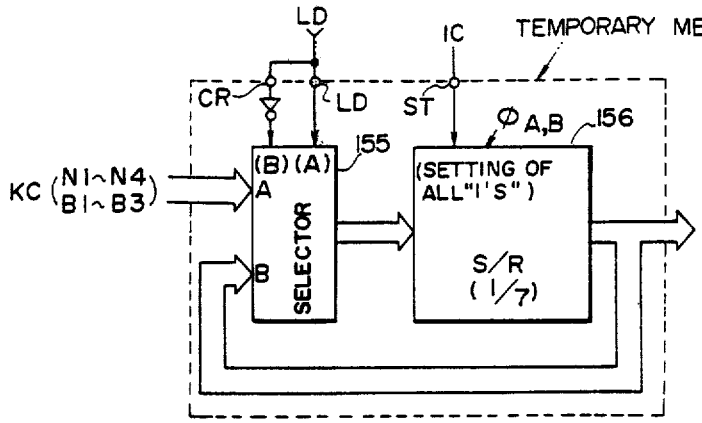
FIG. 5 is a similar diagram showing in more detail the lowest-uk-note temporary memory in the detector circuit of FIG. 4.

FIG. 5 is a more detailed representation of the lowest-uk-note temporary memory 152 used in the detector circuit 15 of FIG. 4. The temporary memory 152 is shown as a combination of a selector 155 and a shift register 156. The selector 155 receives the key data KC (N1–N4 and B1–B3) from the channeling circuit 5 through its first input A and the output from the shift register 156 through its second input B. When the load signal LD (the output from the AND gate A3, FIG. 4) is "1", the selector 155 permits the key-code data KC from the channeling circuit 5 to pass therethrough, and when the load signal is "0", the selector permits the shift register output to pass therethrough.

The shift register 156 is of one-stage, seven-bit configuration, with the bit number corresponding to the number of the bits of the key code (Tables 1 and 2) used in the practice of our invention. Driven by dual-phase clock pulses $\phi$A,B, with a period of 3 $\mu$s, the shift register 156 has all its storage locations set with "1's" upon receipt of a "1" through its set terminal ST.

We have shown the circuit arrangement of FIG. 5 as adapted specifically for use as the lowest-uk-note temporary memory 152. It will be self-evident, then, that the highest-uk-note temporary memory 142 and highest-uk-note memory 144 of FIG. 3, and the lowest-uk-note memory 154 of FIG. 4, can be of configuration analogous with that shown in FIG. 5.

Reference is now directed back to FIG. 1 in order to briefly explain the functions of the new-key-on/off detector circuit 13 included in the chord ensemble note generator circuit 8. Receiving the channeled key-on signal KO1 from the channeling circuit 5 via an AND gate A5 as the input signal KO1', the detector circuit 13 puts it out as such. Additionally, the detector circuit 13 generates and puts out: (1) a UK new-key-on signal UNKO indicative of the depression of a new key on the upper keyboard 1; (2) a new-key-off signal NKOF indicative of the release of a key on the upper 1 or lower 2 keyboard; and (3) a UK any-key-on signal UAKO representative of the holding of some key on the upper keyboard. The AND gate A5 also receives the output EN from the chord ensemble note inhibit circuit 12.

Figure 6:
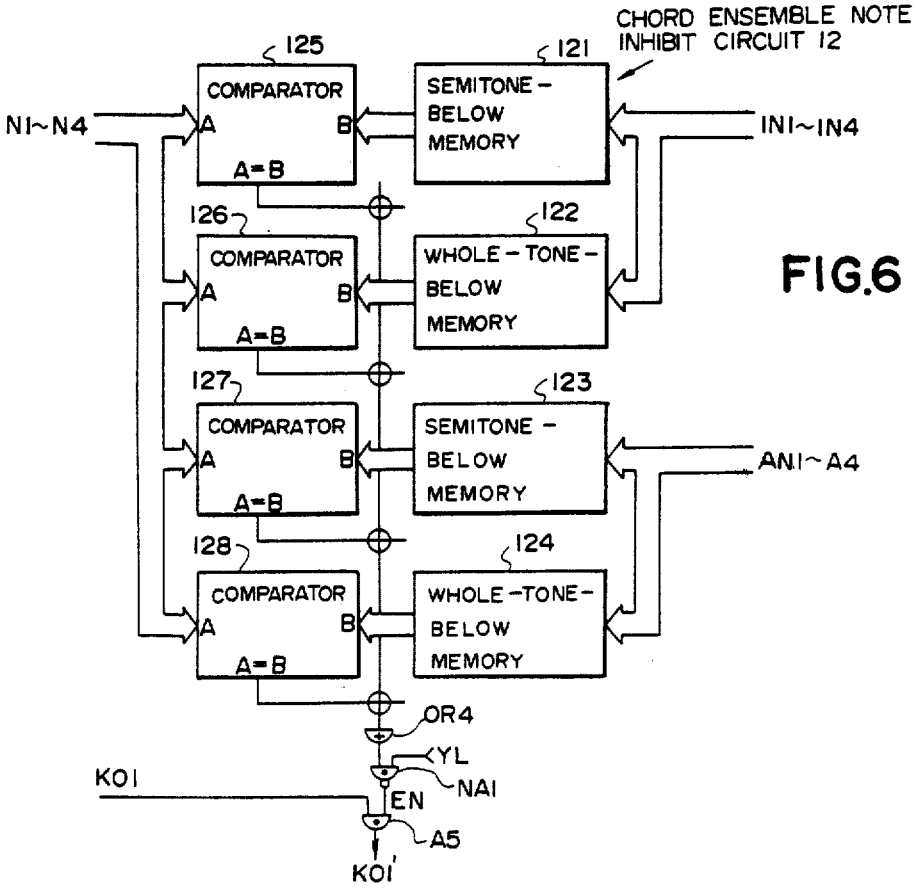
FIG. 6 is a similar diagram showing in detail the chord-ensemble-note inhibit circuit in the instrument of FIG. 1.
Figure 7:
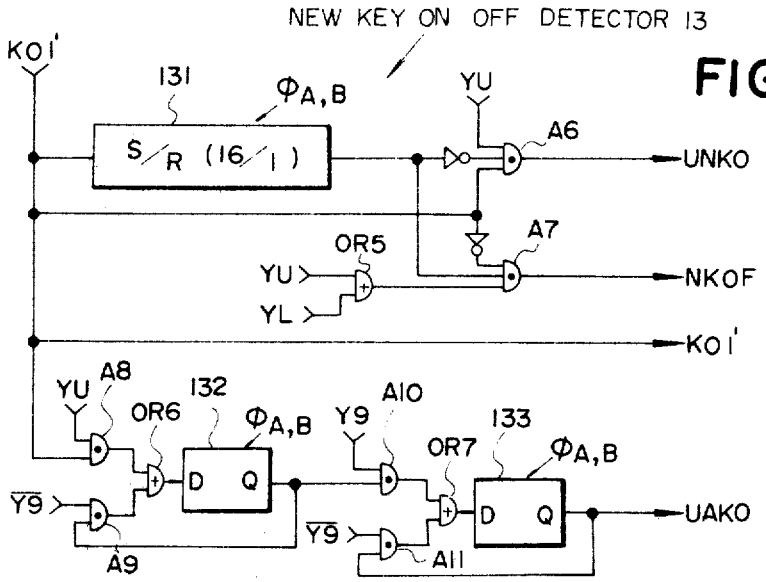
FIG. 7 is a similar diagram showing in detail the new-key-on/off detector circuit in the instrument of FIG. 1.

We will now describe the organization of the chord ensemble note inhibit circuit 12, with reference directed to FIG. 6, and then proceed to the detailed configuration of the new-key-on/off detector circuit 13 shown in FIG. 7. FIG. 6 shows that the chord ensemble note inhibit circuit 12 comprises a first semitone-below memory 121, a first whole-tone-below memory 122, a second semitone-below memory 123, and a second whole-tone-below memory 124. Both first semitone-below memory 121 and first whole-tone-below memory 122 input the note-code data IN1–IN4 included in the lowest-uk-note data IKC provided by the lowest-uk-note detector circuit 15. In response thereto the first semitone-below memory 121 puts out note-code data representative of a note name that is semitone below the note name indicated by the input note-code data IN1–IN4, whereas the first whole-tone-below memory 122 puts out note-code data representative of a note name that is whole-tone below the note name indicated by the input note-code data IN1–IN4.

The second semitone-below memory 123 and second whole-tone-below memory 124, on the other hand, take in the note-code data AN1–AN4 included in the highest uk-note data AKC produced by the highest-uk-note detector circuit 14. In response to the input data the second semitone-below memory 123 puts out note-code data representative of a note name that is semitone below the note name indicated by the input note-code data AN1–AN4, whereas the second whole-tone-below memory 124 puts out note-code data representative of a note name that is whole-tone below the note name indicated by the input data AN1–AN4.

Also included in the chord ensemble note inhibit circuit 12 are four comparator circuits 125, 126, 127 and 128 for comparing the note-code data N1–N4 in the channeled key data KC with the note-code data put out by the four memories 121, 122, 123 and 124, respectively. These comparator circuits produce "1's" upon coincidence of the channeled key data KC with the output data from the respective memories 121 through 124. Since the outputs of the comparator circuits 125 through 128 are all coupled to a four-output OR gate OR4, the output from this OR gate is "1" when the successive sets of key data KC coincide with the output from any of the memories 121 through 124. The "1" output from the OR gate OR4 enters a NAND gate NA1, which is enabled by the timing signal YL, at (F), FIG. 2, during each sequence of lower keyboard channels L1 through L7, thereby zeroing its output EN.

Let it be supposed, for a brief summary of the operation of the chord ensemble note inhibit circuit 12, that the channeling circuit 5 has put out the lower-key key-code data (hereinafter "lower-key" being referred to as "1k") representative of note names that are either whole- or semitone below the note name of the lowest or highest uk depressed key at the moment. The melody chord note inhibit circuit 12 detects such data, as above, and zeroes its output signal EN during the time-divisonal channels to which the data are assigned, thereby preventing the corresponding parts of the key-on signal KO1 from entering the new-key-on/off detector circuit 13.

Thus the inhibit circuit 12 functions to inhibit the production of the chord ensemble notes that are either whole- or semitone below the note name of the lowest or highest played uk key at every moment, as will become better understood from the description of the chord ensemble note control circuit 19 to be given presently. The inhibition of such chord ensemble notes is necessary because, if sounded they would make the tones of the upper keyboard vague and indistinct.

We will now proceed to the description of the new-key-on/off detector circuit 13 shown in detail in FIG. 7. This circuit includes a shift register 131 to which is inputted the key-on signal KO1′ from the AND gate A5, FIG. 1. The shift register 131 is of 16-stage, one-bit design, with the stage number corresponding to the number of sounding channels available in this instrument, and is driven by the dual-phase clock pulses $\phi$A,B having a period of 3 $\mu$s. Consequently the key-on signal KO1′ inputted to the shift register 131 emerges therefrom 48 $\mu$s later, since $16\times3=48$. Thus the input and output signals of the shift register 131 are timed to the same time-divisional channels given at (B), FIG. 2.

After being inverted, the output from the shift register 131 enters a three-input AND gate A6. The other two inputs of this AND gate receives the upper keyboard timing signal YU and the key-on signal KO1′ that has bypassed the shift register 131. If the key-on signal KO1′ newly becomes "1" during the upper keyboard channels U1 through U7, the AND gate A6 puts out a "1" during the same channel as the new "1" of the key-on signal. The output from the AND gate A6 is the desired uk new-key-on signal UNKO. Each pulse of this signal UNKO has a duration of 3 $\mu$s, equal to the length of each of the 16 time-divisional channels.

The new-key-on/off detector circuit 13 further includes a three-input AND gate A7, to which are inputted: (1) the output from the shift register 131; (2) the inversion of the key-on signal KO1′; and (3) the output from a gate OR5 which ORs the upper keyboard timing signal YU and the lower keyboard timing signal YL. Accordingly, if a "1" state of the key-on signal KO1′ disappears during the upper keyboard channels U1 through U7 or lower keyboard channels L1 through L7, the AND gate A7 puts out a "1" during the same channel as the key-on pulse that has disappeared. The output from the AND gate A7 serves as the new-key-off signal NKOF. Each pulse of this signal KNOF also has a 3 $\mu$s duration.

The key-on signal KO1′ is further directed into a delay flip-flop 132 via an AND gate A8 and OR gate OR6. The AND gate A8 is enabled by the timing signal YU during the upper keyboard channels U1 through U7. Driven by the dual-phase clock pulses $\phi$A,B, the delay flip-flop 132 has its output coupled to an AND gate A9, which is enabled by the inversion $\overline{Y9}$ of the timing signal Y9, and thence to the OR gate OR6, for holding the input signal. The output from the delay flip-flop 132 enters another delay flip-flop 133 via an AND gate A10 and OR gate OR7. The AND gate A10 is enabled by the timing signal Y9 during the first lower keyboard channel L1, as at (D), FIG. 2. Also driven by the dual-phase clock pulses $\phi$A,B, the delay flip-flop 133 has its output coupled to an AND gate A11, which is enabled by the inversion $\overline{Y9}$ of the timing signal Y9, and thence to the OR gate OR7, for holding the input signal.

When the channeling circuit 5 puts out the key-on signal KO1′ concerning the keys played on the upper keyboard, the signal is admitted into the delay flip-flop 132 and thence, during the "1" state of the timing signal Y9, into the other delay flip-flop 133. This delay flip-flop 133 is periodically cleared of the stored data at each "1" state of the timing signal Y9. Thus, if the key-on signal KO1′ is "1" during any of the upper keyboard channels U1 through U7, that is, if any key is depressed on the upper keyboard, the delay flip-flop 133 puts out a "1". The output from the delay flip-flop 133 is intended for use as the uk any-key-on signal UAKO.

With reference back to FIG. 1 the key-off control circuit 16 receives both the key-code data KC (N1–N4 and B1–B3) from the channeling circuit 5 and the new-key-off signal NKOF from the new-key-on/off detector circuit 13. In response to these inputs the key-off control circuit 16 puts out: (1) off-key-code data OKC (with note-code data ON1–ON4 and octave-code data OB1–OB3) corresponding to the key data KC indicative of released keys; (2) a uk off signal OUK indicative of the fact that the released key belongs to the upper keyboard; and (3) a key-off signal KOF indicative of the release of keys.

Figure 8:
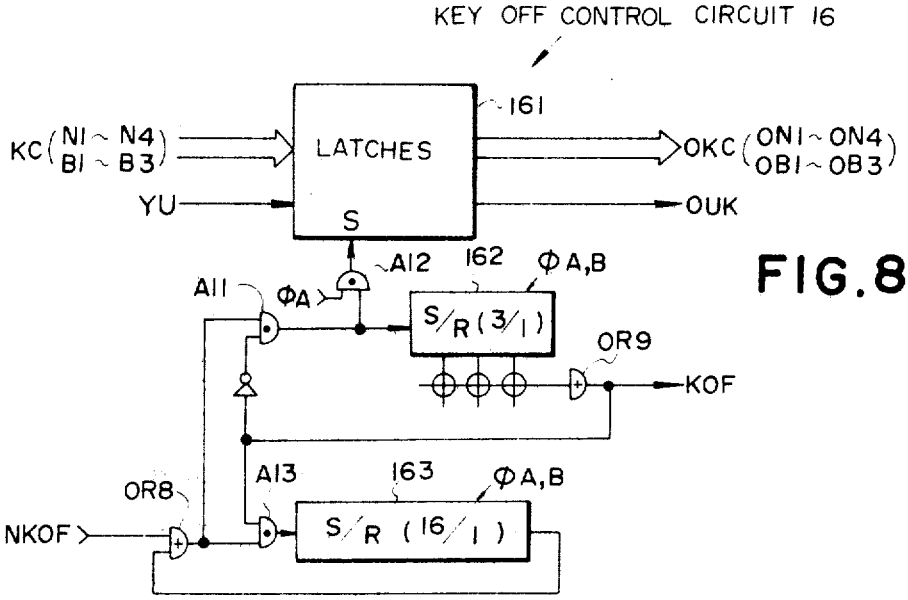
FIG. 8 is a similar diagram showing in detail the key-off control circuit in the instrument of FIG. 1.

FIG. 8 is a detailed illustration of the key-off control circuit 16. Included is a latch circuit 161 having a strobe terminal S to which is applied the new-key-off signal NKOF from the new-key-on/off detector circuit 13, FIGS. 1 and 7, via an OR gate OR8 and AND gates A11 and A12. The AND gate A12 is enabled by a train of clock pulses $\phi$A, with a period of 3 $\mu$s, which rise to "1's" at the midpoints of the time-divisional channels given at (B), FIG. 2. Although the OR gate OR8 applies its output to another AND gate A13 as well, this AND gate is disabled at such times.

The latch circuit 161 inputs the key data KC (N1–N4 and B1–B3) from the channeling circuit 5 and the upper keyboard timing signal YU from the timing signal generator 6. Thus the latch circuit 161 latches the key data KC, and those portions of the upper keyboard timing signal YU, which correspond to the time-divisional channels during which the new-key-off signal NKOF is "1". Each latched key data KC represents a released upper key if the simultaneously latched value of the timing signal YU is "1", and a released lower key if the simultaneously latched value of the timing signal is "0". The key-off control circuit 16 puts out the key data KC and timing signal YU which have been latched as above, as the key-off data OKC (ON1–ON4 and OB-1–OB3) and as the uk off signal OUK.

The key-off control circuit 16 further comprises a shift register 162, to which is inputted the output from the AND gate All. Of three-stagte, one-bit configuration, the shift register 162 is also driven by the dual-phase clock pulses $\phi$A,B. The outputs from the three stages of the shift register 162 are ORed by a gate OR9, and the output from this OR gate serves as the key-off signal KOF. Each pulse of the key-off signal KOF has a duration of 9 $\mu$s.

Besides being used as the key-off signal KOF, the output from the OR gate OR9 enters the AND gate A13 on one hand and, on the other hand, the AND gate A11 after being inverted. During the "1" state of the key-off signal KOF, therefore, the AND gate A13 is enabled, whereas the AND gate A11 is disabled. It will now be seen that in the event of the arrival of a new-key-off pulse NKOF, the succeeding pulses are not applied to the strobe terminal S of the latch circuit 161 but directed into a 16-stage, one-bit shift register 163 via the AND gate A13. Also driven by the dual-phase clock pulses $\phi$A,B, this shift register 163 delays the input new-key-off signal NKOF by 48 ($3\times16$) $\mu$s and applies the delayed signal to the OR gate OR8.

As may have been understood from the foregoing, the shift register 163 serves to temporarily store any new-key-off pulse NKOF incoming during the delivery of a key-off pulse KOF out of the key-off control circuit 16. The stored new-key-off pulse is processed in the above described manner during the same time-divisional channel of the next series of such channels. The necessity for such temporary storage and delayed processing of new-key-off pulses arises from the fact that each key-off pulse KOF produced by this key-off control circuit 16 has a duration of as much as 9 $\mu$s. Should a succession of incoming new-key-off pulses NKOF be processed without any such forced delay, it might become impossible to secure a 9 $\mu$s period for each pulse.

Processing of Upper-Key Data

Figure 9:
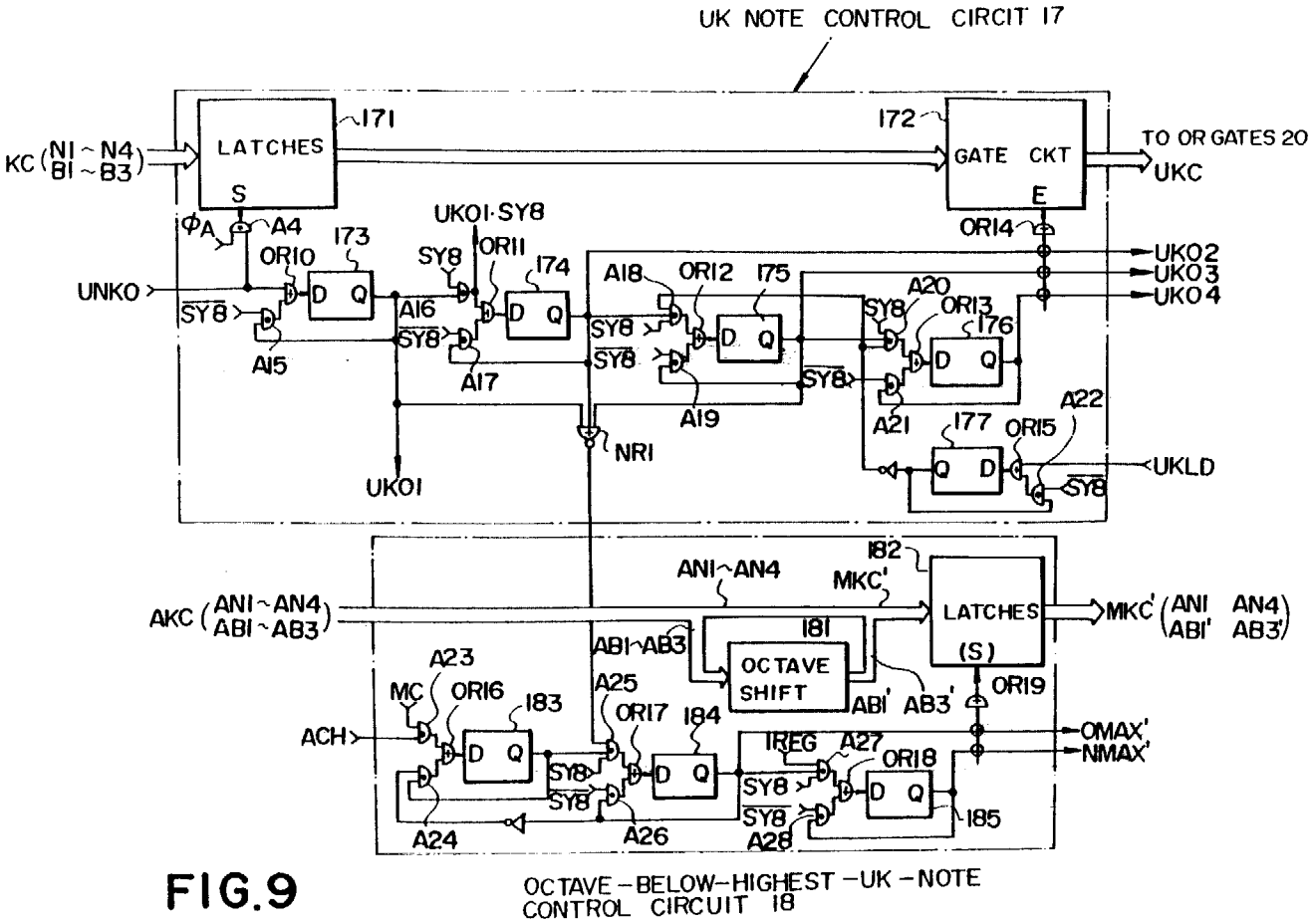
FIG. 9 is a similar diagram showing in detail the uk-note control circuit and octave-below-highest-uk-note control circuit in the instrument of FIG. 1.

The uk note control circuit 17 in the chord ensemble note generator circuit 8 serves to process the uk key-code data KC. As schematically depicted in FIG. 9 in terms of its preferable form, the uk note control circuit 17 includes a latch circuit 171 which directly receives the key data KC from the channeling circuit 5, FIG. 1. Also inputted to this control circuit 17 is the uk new-key-on signal UNKO from the new-key-on/off detector circuit 13, FIGS. 1 and 7. The uk new-key-on signal UNKO is impressed to the strobe terminal S of the latch circuit 171 via an AND gate A14 which is enabled by the clock pulse $\phi$A. Consequently the latch circuit 171 latches the key data KC (N1–N4 and B1–B3) which is assigned to the time-divisional channel during which the uk new-key-on signal UNKO is "1".

The uk new-key-on signal UNKO is also directed into a delay flip-flop 173 via an OR gate OR10. The delay flip-flop 173 has its output coupled to an AND gate A15, which is enabled by the inversion $\overline{SY8}$ of the timing signal SY8, and thence to the OR gate OR10, for holding its input signal. As depicted at (H) in FIG. 2, the timing signal SY8 is "1" during the last or eighth of each of recurrent series of time-divisional channels (G), FIG. 2, associated with a key-code data memory 21 in the chord ensemble note generator circuit 8, as will be detailed later.

All the pertinent circuits presented subsequently should be understood to be driven by dual-phase clock pulses with a period of 1 $\mu$s, unless accompanied by the indicia $\phi$A,B in the drawings.

The output from the delay flip-flop 173 enters another delay flip-flop 174 via an AND gate A16, which is enabled during the "1" state of the timing signal SY8, and an OR gate OR11. The delay flip-flop 174 has its output coupled to an AND gate A17, which is enabled by the inversion $\overline{SY8}$ of the timing signal SY8, and thence to the OR gate OR11, for holding its input signal. It will now be clear that the uk new-key-on signal UNKO that has been introduced into the delay flip-flop 173 is transferred into the other delay flip-flop 174 during the "1" state of the timing signal SY8. The delay flip-flop 174 puts out a signal that will remain "1" during one complete sequence of eight time-divisional channels at (G), FIG. 2.

This output from the delay flip-flop 174 is not only put out of the uk note control circuit 17 as a uk on signal UKO2 but also delivered via a three-input OR gate OR14 to the enable terminal E of a gate circuit 172 connected immediately downstream of the noted latch circuit 171. So actuated, the gate circuit 172 permits the passage therethrough of the uk key data KC that have been latched in the latch circuit 171. The uk key-code data thus emerging from the uk note control circuit 17 are labeled UKC. As is apparent from FIG. 1, the output uk key data UKC from the uk note control circuit 17 enter the key code memory 21 via a network of OR gates 20.

Figure 11:
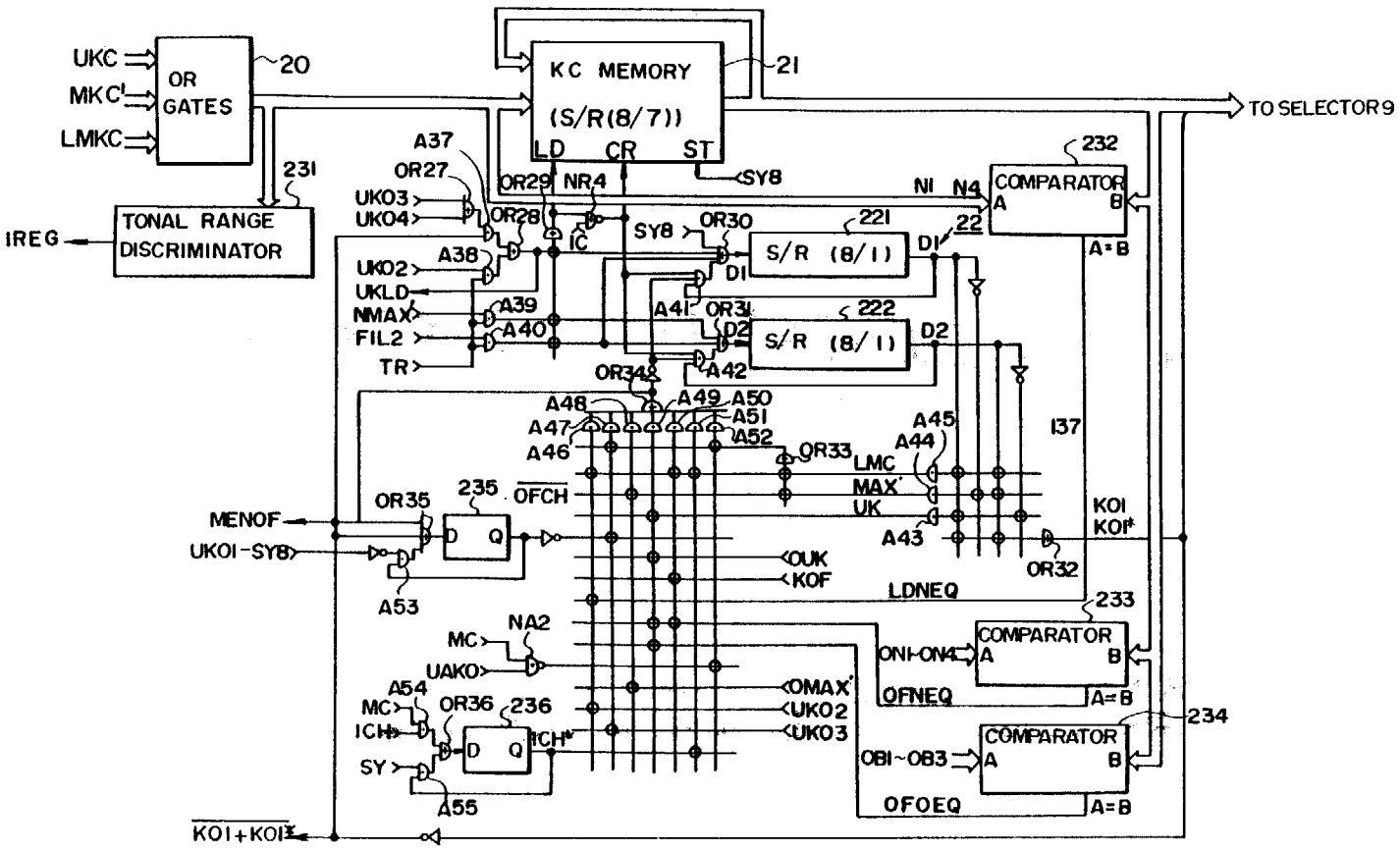
FIG. 11 is a similar diagram showing in detail the key-coded data memory, identification-coded data memory, and memory control circuit in the instrument of FIG. 1.

FIG. 11 shows in detail the key code memory 21 in combination with a discrimination code memory 22 and a memory control circuit 23, both also included in the chord ensemble note generator circuit 8. We will hereinafter refer to the key code memory 21 as the KC memory, and to the discrimination code memory 22 as the DISCR memory, for simplicity and by way of distinction from each other.

The KC memory 21 takes the form of a shift register having eight storage channels or locations corresponding to each of the recurrent series of time-divisional channels given at (G), FIG. 2. To be assigned to and stored on these storage channels of the KC memory 21 are: (1) the uk key-code data UKC from the uk-note control circuit 17; (2) the octave-below-highest-note key code MKC' from an octave-below-highest-note control circuit 18 to be detailed subsequently; and (3) the chord-ensemble-note key code data LMKC, representative of notes which are of the same names as the notes played on the lower keyboard but which are in closer octaval correlation with the lowest uk depressed keys, from the chord-ensemble-note control circuit 19.

The uk key code UKC represents notes played actually on the upper keyboard and so is what we have termed the "primary key data" in the description of the prior art. The octave-below-highest-key-note data MKC' and the chord-ensemble-note data LMKC, on the other hand, represent automatically established (created) notes, not played actually. These data MKC' and LMKC are therefore examples of what we call the "secondary key data".

It is to be noted that the eighth storage channel of the KC memory 21 is not used for data transmission. As the timing signal SY8 at (H), FIG. 2, is applied to the set terminal ST of the KC memory 21, all the bits of the eighth storage channel are set with "1's". These "1's" data on the eighth storage channel are to be deleted as the output from the KC memory 21 passes the selector 9, as will be later discussed in further detail in conjunction with FIG. 12.

The DISCR memory 22 is comprised of two shift registers 221 and 222, each of eight-stage, one-bit construction. Fed into the respective shift registers 221 and 222 are the bits D1 and D2 of data coded in accordance with a binary "discrimination code". The discrimination-code data on each stage or storage location of the DISCR memory 22 serve the purpose of discriminating the key-code on the corresponding storage channel of the KC memory 21 as either the uk key code UKC, the octave-below-highest-note key code MKC', or the chord-ensemble-note data LMKC. The shift registers 221 and 222 store and hold the discrimination-code D1 and D2 via respective AND gates A41 and A42.

Emerging from the DISCR memory 22, the discrimination-code D1 and D2 enter a decoder 137 composed of three AND gates A43, A44 and A45. The decoder 137 decodes the discrimination-code D1 and D2 into an upper-keyboard signal UK, an octave-below-highest-note signal MAX', and a chord-ensemble-note signal LMC. The upper keyboard signal UK becomes "1" during the time-divisional channels of the KC memory 21 to which there are assigned the uk key code UKC. The octave-below-highest-note signal MAX' becomes "1" during the time-divisional channels of the KC memory to which there are assigned the octave-below-highest-note key code MKC'. The chord-ensemble-note signal LMC becomes "1" during the time-divisional channels of the KC memory to which there are assigned the chord-ensemble-note data LMKC.

Table 4 below represents the discrimination code in relation to the output signals UK, MAX' and LMC from the decoder 137.

TABLE 4

| DISCRIMINATION CODE | | |
|---|---|---|
| Decoder | DISCR Code Bits | |
| Output Signals | D1 | D2 |
| UK | 1 | 0 |
| MAX' | 0 | 1 |
| LMC | 1 | 1 |

The discrimination-code "00" represents the invalidation of the key-code on the KC memory channel in question. The shift register 221 of the DISCR memory 22 receives the timing signal SY8 via an OR gate OR30. Thus, during the unused eighth time-divisional channel of the KC memory 21, the discrimination code "10" indicative of the assignment of uk key data UKC to that channel is introduced into the DISCR memory 22.

Seen at 232 in FIG. 11 is a comparator circuit which receives through its first input A the note-code bits N1–N4 (with a pulse duration of 8 μs) included in the key code inputted to the KC memory 21 and, through its second input B, the note-code bits N1–N4 (with a pulse duration of 1 μs) included in the key-code data issuing from the KC memory. The comparator circuit 232 puts out a load-note coincidence signal LDNEQ upon agreement of the note-code data N1–N4 incoming through its inputs A and B. This signal LDNEQ becomes "1" during any of the eight time-divisional channels of the KC memory 21 to which there has already been assigned a key-code data representative of the same note name as a key-coded data set going to enter the KC memory.

Another comparator circuit 233 receives through its first input A the note-code bits ON1–ON4 included in the key-off key-code OKC from the key-off control circuit 16, FIGS. 1 and 8, and, through its second input B, the note-code bits N1–N4 of the key-code output from the KC memory 21. The comparator circuit 233 puts out an off-note coincidence signal OFNEQ of a "1" state upon agreement of the note-code bits ON1–ON4 and N1–N4. The "1" state of this signal OFNEQ coincides in time with any of the eight time-divisional channels of the KC memory 21 to which there has already been assigned a key-code representative of the same note name as a key-off data set from the key-off control circuit 16.

Still another comparator circuit 234 receives through its first input A the octave-code bits OB1–OB3 of the key-off key-code OKC from the key-off control circuit 16 and, through its second input B, the octave-code bits B1–B3 of the key-code output from the KC memory 21. The comparator circuit 234 puts out an off-octave coincidence signal OFOEQ of a "1" state upon agreement of the octave-codes OB1–OB3 and B1–B3.

A reference back to FIG. 9 will show that the uk-note control circuit 17 illustrated in detail therein provides the uk on signal UKO2, which in fact is the output from the delay flip-flop 174 included in that control circuit. This uk on signal UKO2 enters an AND gate A38 in the memory control circuit 23, FIG. 11. Also inputted to the AND gate A38 is a channel truncate signal TR from a truncate circuit 24, FIG. 1, in the chord ensemble note generator circuit 8.

Per se of conventional design, the truncate circuit 24 receives from the memory control circuit 23: (1) an empty-channel signal $\overline{KO1}$ indicative of those KC memory channels on which data have been canceled or invalidated; and (2) a cancellation signal MENOF indicative of those KC memory channels on which data must be canceled. In response to these input signals the truncate circuit 24 puts out the channel truncate signal TR suggestive of those KC memory channels to which incoming data are to be assigned. The channel truncate signal TR indicates only one of the empty channels at one time, becoming "1" at a time corresponding to that channel.

Thus the AND gate A38 in the memory control circuit 23 puts out a "1" when the "1" state of the uk on signal UKO2 from the uk-note control circuit 17 coincides with one of the empty channels indicated by the channel truncate signal TR. The "1" output from the AND gate A38 enters the load terminal LD of the KC memory 21 via two successive OR gates OR28 and OR29. The output from the OR gate OR29 is further applied to the reset terminal CR of the KC memory 21 after being inverted by a NOR gate NR4 to which is also inputted the "initial clear" signal IC. So actuated, the KC memory 21 accepts and stores the set of upper-key data UKC from the OR gates 20 on its channel specified by the channel truncate signal TR.

The OR gate OR28 also delivers the "1" to the shift register 221 via an OR gate OR30. The DISCR memory 22, composed of the shift registers 221 and 222 as aforesaid, thus stores the discrimination code data set "10", meaning that the data set stored at that instant in the KC memory 21 is of the upper-key data UKC.

The output from the OR gate OR28 is further directed into the uk note control circuit 17, FIG. 9, as a uk-note load signal UKLD. As will be noted by referring back to this figure, the uk-note load signal UKLD enters a delay flip-flop 177 via on OR gate OR15. The delay flip-flop 177 holds the input signal via an AND gate A22, to which is also inputted the inversion $\overline{SY8}$ of the timing signal SY8. The output from the delay flip-flop 177 enters both AND gates A18 and A20 after being inverted. Consequently, as the uk-note load signal UKLD becomes "1" in response to the uk on signal UKO2, the AND gate A18 is disabled, preventing signal transfer from delay flip-flop 174 to delay flip-flop 175 during the "1" state of the timing signal SY8 also input to the gate.

Referring again to FIG. 11, the uk on signal UKO2 is also applied to a three-input AND gate A46 in the memory control circuit 23. The other two inputs of this AND gate receive the load-note coincidence signal LDNEQ from the comparator circuit 232 and the chord-ensemble-note signal LMC from the discrimination code decoder 137. Expressed in terms of a logical formula, therefore, the inputs ANDed by the gate A46 are:

UKO2·LDNEQ·LMC

Thus the AND gate A46 puts out a "1" if the key-code in channeled storage in the KC memory 21 include a chord-ensemble-note data indicative of the same note name as the uk key names going to enter the KC memory, provided that the uk on signal UKO2 is "1" at the moment. The "1" output from the AND gate A46 coincides in time with that one of the KC memory channels to which there has been assigned the chord-ensemble-note data of the same note name as the upper-key data in question. The "1" output from the AND gate A46 travels through a seven-input OR gate OR34, then is inverted, and then is applied to both AND gates A41 and A42 associated with the respective shift registers 221 and 222 of the DISCR memory 22. The result is the clearing, or setting at "00", of the discrimination code (D1 and D2) corresponding to the KC memory channel to which there has been assigned the chord-ensemble-note data under consideration.

The seven-input OR gate OR34 also delivers its output to a delay flip-flop 235 via a three-input OR gate OR35. The delay flip-flop 235 has its output coupled to an AND gate A53, which also inputs the inversion of a signal UKO1·SY8, and thence to the OR gate OR35, for holding the input signal. The signal UKO1·SY8 is put out by the AND gate A16 in the uk note control circuit 17, FIG. 9, and becomes "1" in synchronism with the timing signal SY8 when a key is newly depressed on the upper keyboard.

As may have been understood from the foregoing, the uk key-on signal UKO2 from the uk note control circuit 17 becomes "1" in response to the holding of each key on the upper keyboard 1. If the KC memory 21 has a blank channel in timewise agreement with the uk on pulse, the uk key-code representative of the depressed upper key is assigned to the blank channel. However, if this uk key code is of the same note name as the chord-ensemble-note key code already stored in one of the channels of the KC memory 21, the chord-ensemble-note key code is invalidated.

It will be evident, then that the uk note load signal UKLD from the OR gate OR28 remains "0" if the uk key code has not been admitted into the KC memory 21 by the "1" state of the uk key-on signal UKO2, that is, if the KC memory has had no empty channel. In that case the AND gate A19 in the uk note control circuit 17, FIG. 9, remains enabled, so that the output from the delay flip-flop 174 enters the delay flip-flop 175 via the AND gate A18 and OR gate OR12, in synchronism with the timing signal SY8. The delay flip-flop 175 holds the input signal via the AND gate A19 which is enabled during the "1" state of the signal $\overline{SY8}$. The delay flip-flop 175 also impresses its output to the enable terminal E of the gate circuit 172 via the three-input OR gate OR14 thereby causing the gate circuit to permit the passage of the uk key code UKC therethrough. The output from the delay flip-flop 175 is further directed into the memory control circuit 23, FIG. 11, as an uk on-signal UKO3.

In the memory control circuit 23 the uk on-signal UKO3 is applied to an AND gate A37 via an OR gate OR27. Impressed to the other input of this AND gate A37 is the inversion $\overline{KO1+KO1^*}$ of the output KO1+-KO1* from a gate OR32 which ORs the outputs from the shift registers 221 and 222 constituting the DISCR memory 22. The inverted signal $\overline{KO1+KO1^*}$ becomes "1" in timed relation to the previously cleared channel of the KC memory 21, since the corresponding discrimination code from the DISCR memory 22 is "00".

We have stated that if, during the "1" state of the aforesaid uk on-signal UKO2, a chord-ensemble-note key code LMKC of the same note name as the uk key code UKC corresponding to the uk on-pulse has been stored on some channel of the KC memory 21, the chord-ensemble-note key code is invalidated to clear the channel. Thus the signal $\overline{KO1+KO1^*}$ becomes "1" in synchronism with the cleared channel.

It is therefore apparent that the AND gate A37 puts out a "1" in timed relation to the cleared channel of the KC memory 21. This "1" is applied to the OR gate OR28. Thus, as in the case of the above explained uk on-signal UKO2, the KC memory 21 admits and stores the uk key code UKC in question. Concurrently the DISCR memory 22 stores the discrimination code "10" suggestive of a uk note. It will also be seen that the uk note load signal UKLD from the OR gate OR28 becomes "1", disabling the AND gate A20 in the uk note control circuit 17, FIG. 9. The disabled AND gate A20 restrains the output from the flip-flop 175 from passing on to the flip-flop 176 during the "1" state of the timing signal SY8.

The uk on-signal UKO3 is also applied to a three-input AND gate A47 having its output coupled to the mentioned seven-input OR gate OR34. The other two inputs of the AND gate A47 receive the inversion $\overline{OFCH}$ of the output from a delay flip-flop 235 and the output from a gate OR33 which ORs the octave-below-highest-note signal MAX' and the chord-ensemble-note signal LMC. The terms ANDed by the gate A47 can therefore be formulated as:

$$UKO3 \cdot (MAX' + LMC) \cdot \overline{OFCH}$$

Stated in more concrete terms, the AND gate A47 puts out a "1" if the key-code in channeled storage in the KC memory 21 include octave-below-highest-note key code or chord-ensemble-note key code, and when the uk on-signal UKO3 is "1", provided that no channel has been cleared during the "1" state of the uk on-signal UKO2. The "1" output from the AND gate A47 is timed to coincide with that one of the KC memory channels to which there are assigned the octave-below-highest-note key code or the chord-ensemble-note key code.

The "1" output from the AND gate A47 passes the OR gate OR34 and, after being inverted, is applied to the AND gates A41 and A42. The result is the clearing, or setting at "00", of the discrimination-code in the DISCR memory 22 corresponding to the KC memory channel to which there has been assigned the octave-below-highest-note key code or chord-ensemble-note key code.

The "1" output from the AND gate A47 is also applied via the OR gates OR34 and OR35 to the delay flip-flop 235 for storage therein. Thereupon the inversion $\overline{OFCH}$ of the output from the delay flip-flop 235 becomes "0" to disable the AND gate A47. Thus, although two or more of octave-below-highest-note or chord-ensemble-note key codes may have been stored on the channels of the KC memory 21, only the first of such channels is cleared as above.

The foregoing will have made clear that, during the "1" state of the uk on-signal UKO3, the uk key code UKC may be admitted into the KC memory 21 and assigned to its channel that may have been cleared during the "1" state of the uk on-signal UKO2. However, if no channel has been cleared during the "1" state of the upper-key-on signal UKO2, then the upper-key data set is not yet admitted into the KC memory 21; instead, during the same "1" state of the uk on-signal UKO3, there is invalidated one of the octave-below-highest-note key codes or chord-ensemble-note key codes in the storage channel of the KC memory.

What follows is the discussion of the case where the uk key code UKC under consideration has not been stored in the KC memory 21 during the "1" state of the uk on-signal UKO3. With reference to FIG. 9 the output from the delay flip-flop 175 enters the delay flip-flop 176 via the AND gate A20, to which there is also inputted the timing signal SY8, and the OR gate OR13. The delay flip-flop 176 holds the input signal via an AND gate A21 which is enabled during the "1" state of the inverted timing signal $\overline{SY8}$. The output from the delay flip-flop 176 is applied via the OR gate OR14 to the enable terminal E of the gate circuit 172 to permit the passage of the uk key code UKC therethrough, besides being fed into the memory control circuit 23, FIG. 11, as the uk on-signal UKO4.

In the memory control circuit 23, as in the case of the uk on-signal UKO3, the signal UKO4 is impressed to the OR gate OR28 via the OR gate OR27 and the AND gate A37, the latter being enabled during the "1" state of the signal $\overline{KO1+KO1^*}$. Since the "1" state of this signal $\overline{KO1+KO1^*}$ is in timewise coincidence with the KC memory channel that has been cleared during the "1" state of the uk on-signal UKO3, the uk key code UKC is admitted into the KC memory 21 as assigned to the previously cleared channel. Further the DISCR memory 22 accepts and stores the discrimination code "10" indicative of uk key code. Thus, in response to the uk on-signal UKO4, the memory control circuit 23 assigns the uk key code UKC to the channel it has cleared in response to the preceding uk on-pulse UKO3.

The above described operation of the circuitry of FIG. 11, in relation to the upper-key-note control circuit 17 of FIG. 9, may be summarized as follows. The upper-key-note control circuit 17 provides the three different upper-key-on signals UKO2, UKO3 and UKO4 to make it possible for the memory control circuit 23 to effect preferential storage of the upper-key data UKC in the KC memory 21. The upper-key-on signal UKO2 is used for the invalidation of a melody-chord-note data set, if any, of the same note name as the upper-key data set UKC to be introduced into the KC memory 21. The upper-key-on signal UKO3 causes the memory control circuit 23 to delete one of the sets of octave-below-highest-upper-key-note or melody-chord-note data that have been in storage in the KC memory 21. The last upper key-on signal UKO4 is utilized for causing the KC memory 21 to accept and store the upper-key data set on its channel cleared by the upper-key-on signal UKO3.

When a key is released on the upper keyboard, the corresponding uk key code UKC must be deleted from the KC memory 21. Used toward this end is the output from a four-input AND gate A49 in the memory control circuit 23, FIG. 11, coupled to the seven-input OR gate OR34. Inputted to this AND gate A49 are: (1) the off-note coincidence signal OFNEQ from the comparator circuit 233; (2) the off-octave coincidence signal OFOEQ from the comparator circuit 234; (3) the uk off-signal OUK from the key-off control circuit 16, FIGS. 1 and 8; and (4) the uk signal UK from the discrimination code decoder 137. Expressed as a logical formula, the terms ANDed by the gate A49 are:

$$OFNEQ \cdot OFOEQ \cdot OUK \cdot UK$$

In response to these inputs the AND gate A49 puts out a "1" in timed relation to the KC memory channel on which there has been stored the uk key code UKC corresponding to the released upper key. The "1" output from the AND gate A49 passes the OR gate OR34, then is inverted, and then is applied to the AND gates A41 and A42. In the DISCR memory 22, therefore, the discrimination code (D1 and D2) corresponding to the released upper key is cleared or reset to "00", resulting in the invalidation of the uk key code and in the clearing of the pertinent channel.

Processing of Supplementary-Note Data

1. Octave-Below-Highest-Note Data

FIG. 9 shows, in combination with the uk note control circuit 17, the octave-below-highest-note control circuit 18. Included in this circuit 18 is an octave shift circuit 181 to which there are inputted the octave-code data AB1–AB3 forming part of the highest-note key code AKC (AN1–AN4 and AB1–AB3) from the highest-note detector circuit 14, FIGS. 1 and 3. The octave shift circuit 181 alters the input data AB1–AB3 into an octave-code AB1'–AB3' representative of the octave just below the one indicated by the input data. The output data AB1'–AB3' are recombined with the note-code AN1–AN4 to provide the octave-below-highest-note key code MKC', prior to entrance into a latch circuit 182.

The octave-below-highest-note control circuit 18 also accepts the highest-note change signal ACH from the highest-note detector circuit 14. The highest-note change signal ACH enters a first delay flip-flop 183 via an AND gate A23 and OR gate OR16. The AND gate A23 also inputs the chord ensemble signal MC, FIG. 1, which becomes "1" upon closure of the chord ensemble selector switch 7. The first delay flip-flop 183 has its output coupled to an AND gate A24 and thence to the OR gate OR16, for holding the input signal.

The output from the first delay flip-flop 183 enters a second delay flip-flop 184 via a three-input AND gate A25 and OR gate OR17. Applied to the other two inputs of the AND gate A25 are the output from a NOR gate NR1 in the uk note control circuit 17 and the timing signal SY8. The gate NR1 in the uk note control circuit 17 NORs the outputs from the three delay flip-flops 173, 174 and 175 used therein. The inputting of the output from the NOR gate NR1 to the AND gate A25 is necessary for processing the uk key code in preference to the octave-below-highest-note key code.

The second delay flip-flop 184 delivers its output to an AND gate A26, to which there is also inputted the inverted timing signal $\overline{SY8}$, and thence to the OR gate OR17. Additionally, after being inverted, the output from the second delay flip-flop 184 enters the AND gate A24 and so is used for disabling same. Thus the highest-note-change signal ACH that has been introduced into the first delay flip-flop 183 is transferred into the second delay flip-flop 184 in timed relation to the timing signal SY8. The output from the second delay flip-flop 184 is impressed via an OR gate OR19 to the strobe terminal S of the latch circuit 182 for causing same to latch the octave-below-highest-note key code MKC'. The output from the second delay flip-flop 184 also issues from the octave-below-highest-note control circuit 18 as an output signal OMAX' and enters the memory control circuit 23, FIG. 11.

In the memory control circuit 23 it is an AND gate A48, having its output coupled to the seven-input OR gate OR 34, that receives the output signal OMAX' from the circuit 18. The AND gate A48 also inputs the octave-below-highest-note signal MAX' from the discrimination code decoder 137. The terms ANDed by this gate A48 can therefore be formulated as:

$$OMAX' \cdot MAX'$$

Accordingly the AND gate A48 puts out a "1" during the "1" state of the signal OMAX' and in timed relation to that one of the channels in the KC memory 21 on which there has been stored the previous octave-below-highest-note key code MKC'. The "1" output from the AND gate A48 passes the OR gate OR34 and, after being inverted, enters the two AND gates A41 and A42 associated with the DISCR memory 22. In this memory, therefore, the discrimination code (D1 and D2) corresponding to the previous octave-below-highest-note key code MKC' is cleared, resulting in the invalidation of the key code from the KC memory channel in which it has been stored.

It will be observed from FIG. 11 that a tonal range discriminator circuit 231 is connected just downstream of the OR gates 20. This discriminator circuit receives the octave-below-highest-note key code MKC' that has been latched as aforesaid in the latch circuit 182, FIG. 9, in the control circuit 18. It is the function of the discriminator circuit 231 to ascertain whether or not each octave-below-highest-note key code MKC' established (created) in the control circuit 18 represents a note falling within the tonal range of the upper keyboard. If it does, the upper keyboard range signal IREG put out by the discriminator circuit 231 becomes "1". The upper keyboard range signal IREG is applied to a three-input AND gate A27, FIG. 9, in the control circuit 18.

As the AND gate A27 becomes enabled by the upper keyboard range signal IREG and by the timing signal SY8, the output from the second delay flip-flop 184 passes therethrough and, via an OR gate OR18, enters a third delay flip-flop 185. This third delay flip-flop has its output coupled to an AND gate A28, which is enabled during the "1" state of the inverted timing signal SY8, and thence to the OR gate OR18, for holding the input signal.

The third delay flip-flop 185 applies its output to the strobe input S of the latch circuit 182 via the OR gate OR19 thereby causing the latch circuit to re-latch the incoming octave-below-highest-note key code MKC'. The latched data are directed into the KC memory 21, FIG. 11, via the OR gates 20. The output from the third delay flip-flop 185 also emerges from the control circuit 18 as an output signal NMAX' and enters an AND gate A39, FIG. 11, in the memory control circuit 23.

Applied to the other input of the AND gate A39 is the channel truncate signal TR from the truncate circuit 24, FIG. 1. The AND gate A39 puts out a "1" in timed relation to the KC memory channel indicated by the channel truncate signal TR. The AND gate A39 applies its output to the OR gate OR29 and thence directly to the load terminal LD of the KC memory 21 and also, via the NOR gate NR4, to the reset terminal CR of the KC memory. Further the AND gate A39 delivers its output to the shift register 222 of the DISCR memory 22 via the OR gate OR31. Each octave-below-highest-note key code MKC' is admitted into the KC memory 21 at a time corresponding to that of the storage channels therein which is specified by the channel truncate signal TR. The DISCR memory 22, on the other hand, accepts the discrimination code "01" representative of octave-below-highest-note key code.

As may have been understood from the foregoing, the highest-note-change signal ACH is employed to control the channeled storage of the octave-below-highest-note data MKC' in the KC memory 21. Such channeled storage of the data MKC' takes place through two consecutive stages of operation. In the first stage the key code MKC' now stored in the KC memory 21 is invalidated, and also it is ascertained whether or not the next key code MKC' represents a note within the tonal range of the upper keyboard. If the new data set is found to represent a valid note, then, in the second stage, this key code is introduced into the KC memory 21 as assigned to the channel specified by the channel truncate signal TR.

2. Chord-Ensemble-Note Data

Figure 10:
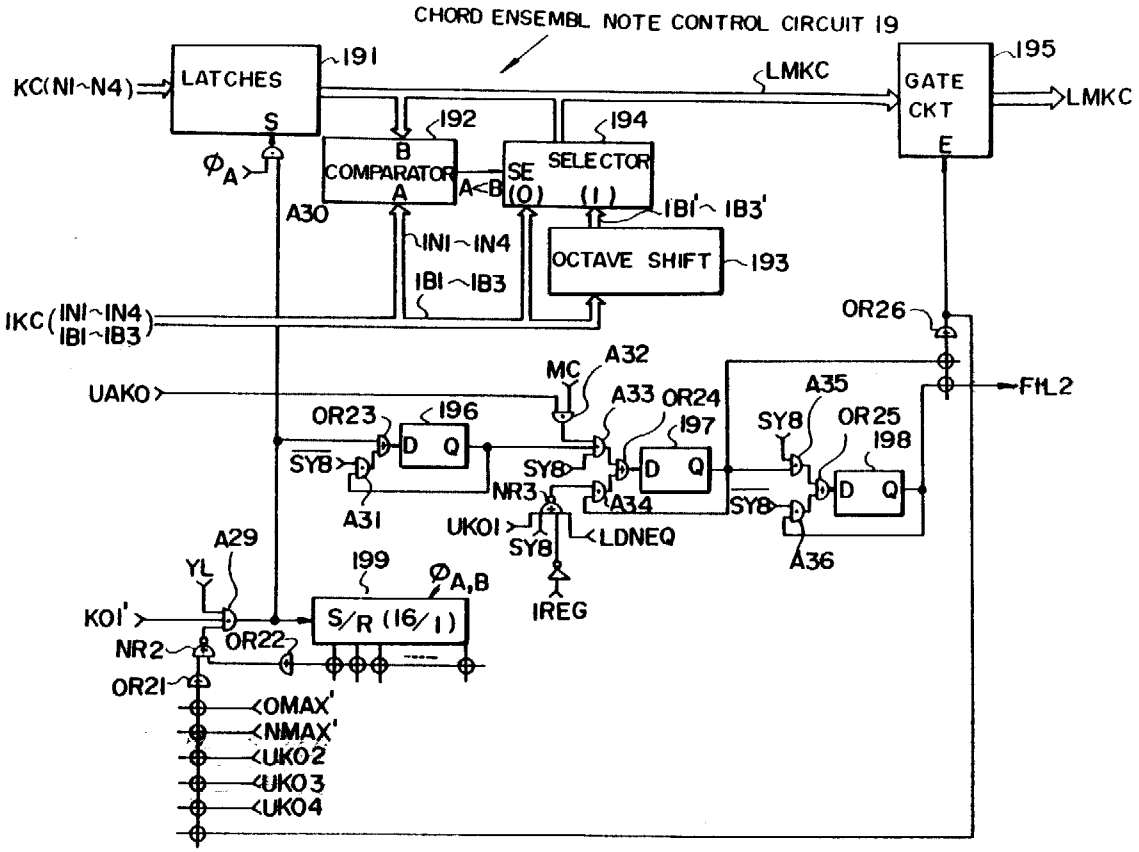
FIG. 10 is a similar diagram showing in detail the chord-ensemble-note control circuit in the instrument of FIG. 1.

FIG. 10 is a schematic, more detailed representation of the chord ensemble note control circuit 19 previously referred to in relation to FIG. 1. A latch circuit 191 in the chord note ensemble control circuit 19 inputs the note-code bits N1–N4 included in the key-code KC (N1–N4 and B1–B3) from the channeling circuit 5, FIG. 1. A comparator circuit 192 receives through its first input A the note-code IN1–IN4 included in the lowest-note key-code IKC (IN1–IN4 and IB1–IB3) from the lowest-note detector circuit 15, FIGS. 1 and 4, and, through its second input B, the output from the latch circuit 191. Actuated by the output from the comparator circuit 192, a selector 194 accepts through its input "0" the octave-code bits IB1–IB3 included in the lowest-note key code IKC and, through its input "1", the output IB1'–IB3' from an octave shift circuit 193. This octave shift circuit functions to modify each set of octave-coded data IB1–IB3 into that, IB1'–IB3', indicative of the octave just below the one represented by the input key code.

Another input to the chord ensemble note control circuit 19 is the key-on signal KO1' from the new-key-on/off detector circuit 13, FIGS. 1 and 7. The key-on signal KO1' enters a three-input AND gate A29. The other two inputs of the AND gate A29 receive the lower keyboard timing signal YL and the output from a NOR gate NR2. The NOR gate NR2 accepts the outputs from a six-input OR gate OR21 and a 16-input OR gate OR22.

The signals applied to the six inputs of the OR gate OR21 are: (1) the output from an OR gate OR26 (which is also impressed to the enable terminal E of the gate circuit 195, as will be later explained in more detail); (2) the three uk on-signals UKO2, UKO3 and UKO4 from the uk note control circuit 17, FIGS. 1 and 9; and (3) the output signals OMAX' and NMAX' from the octave-below-highest-note control circuit 18, FIGS. 1 and 9. The other OR gate OR22 receives the outputs from the individual stages of a 16-stage, one-bit shift register 199.

The NOR gate NR2 puts out a "1", therefore, when neither of the uk key code, the octave-below-highest-note key code, and chord-ensemble-note key code are being processed in the memory control circuit. Thus, provided that no such key codes are being processed, the AND gate A29 is enabled during the lower keyboard channels L1 through L7, permitting the passage therethrough of those portions of the key-on signal KO1' which correspond to the lower keyboard. The AND gate A29 delivers its output to the strobe terminal S of the latch circuit 191 via an AND gate A30 which is enabled by the clock pulses $\phi$A. The latch circuit 191 responds by latching the note-code N1–N4 which is associated with the lower keyboard.

The AND gate A29 also applies its output to the shift register 199 driven by the dual-phase clock pulses $\phi$A,B with a period of 3 $\mu$s. The 16 stages of this shift register correspond to the number of time-divisional channels to which key codes are assigned by the channeling circuit 5. As has been mentioned, the outputs from the individual stages of this shift register are inputted to the OR gate OR22 coupled to the NOR gate NR2. Thus, upon introduction of a "1" into the shift register 199, the AND gate A29 is held disabled for 48 $\mu$s thereafter, since $3\times16=48$, so that the ensuing key-on pulses are blocked from passage therethrough during the 48 $\mu$s period. After the lapse of this period, however, the next key-on pulse is allowed to pass the AND gate A29 during the time-divisional channel associated therewith and put to the same purposes as the preceding pulse.

After being latched as above in the latch circuit 191, each 1k note-code N1–N4 enters the comparator circuit 192 through its second input B. The comparator circuit 192 compares this 1k note-code with the corresponding lowest-uk-note key code IN1–IN4 incoming through its first input A. The output from the comparator circuit 192 is "1" if the lowest-uk-note key code IN1–IN4 represents a note name lower than that of the 1k note-code, and "0" if otherwise.

The comparator circuit 192 delivers its output to the select terminal SE of the selector 194. This selector allows the passage therethrough of the octave-code bits IB1–IB3 applied to its input "0" if the select signal is "0", and of the octave-code bits IB1'–IB3' applied to its input "1" if the select signal is "1". Emerging from the selector 194, the octave-code IB1–IB3 or IB1'–IB3' are reunited (recombined) with the note-code N1–N4 coming out of the latch circuit 191 and jointly enter the gate circuit 195. The key codes thus applied to the gate circuit 195 are the chord-ensemble-note key codes LMKC, representative of chord ensemble notes that are of the same note names as the keys played on the lower keyboard but which invariably fall within an octave below the lowest uk depressed key at the moment.

The key-on signal KO1' that has passed the AND gate A29 is further directed into a delay flip-flop 196 via an OR gate OR23. This delay flip-flop has its output coupled to an AND gate A31, which is enabled during the "1" state of the inverted timing signal $\overline{SY8}$, and thence to the OR gate OR23, for holding the input signal. The output from the delay flip-flop 196 enters a three-input AND gate A33. Also input to the AND gate A33 are the timing signal SY8 and the output from an AND gate A32, which receives the melody chord note signal MC and the uk any-key-on signal UAKO from the new-key-on/off detector circuit 13, FIGS. 1 and 7.

Accordingly the AND gate A33 is enabled in synchronism with the timing signal SY8 if any uk key is being held and if the chord ensemble selector switch 7, FIG. 1, is closed. While being so enabled, the AND gate A33 passes the output from the delay flip-flop 196 on to another delay flip-flop 197 via an OR gate OR24. The delay flip-flop 197 has its output coupled to an AND gate A34, which is enabled by the "1" output from a four-input NOR gate NR3, and thence to the OR gate OR24, for holding the input signal. The four inputs of the NOR gate NR3 receive: (1) the uk on-signal UKO1 from the uk note control circuit 17, FIGS. 1 and 9; (2) the timing signal SY8; (3) the inversion of the upper keyboard range signal IREG from the tonal range discriminator circuit 231, FIG. 11; and (4) the load-note coincidence signal LDNEQ from the memory control circuit 23, FIGS. 1 and 11. The delay flip-flop 197 delivers its output to the enable terminal E of the gate circuit 195 via the OR gate OR26 thereby causing the gate circuit to pass the incoming chord-ensemble-note key code LMKC.

Thus established and put out by the chord ensemble note control circuit 19, the chord-ensemble-note key code LMKC enters the tonal range discriminator circuit 231, FIG. 11, via the OR gates 20. The discriminator circuit 231 determines whether or not each incoming set of chord-ensemble-note key code LMKC represents a note within the tonal range of the upper keyboard and, if it does, puts out the upper keyboard range signal IREG of a "1" state. After being inverted, the upper keyboard range signal IREG is input as aforesaid to the four-input NOR gate NR3, FIG. 10, in the chord ensemble note control circuit 19. Accordingly, should any set of chord-ensemble-note key code MLKC represent a note falling outside the tonal range of the upper keyboard, resulting in the "0" state of the upper keyboard range signal IREG, then the NOR gate NR3 functions to clear the delay flip-flop 197. This chord-ensemble-note key code is not admitted into the KC memory 21. We will subsequently explain how the KC memory 21 accepts and stores the chord-ensemble-note key code LMKC on its storage channels.

As we have stated, the NOR gate NR3 also receives the load note coincidence signal LDNEQ from the comparator circuit 232, FIG. 11. The delivery of this signal LDNEQ to the NOR gate NR3 serves the purpose of preventing the KC memory 21 from accepting any chord-ensemble-note key code LMKC representative of the same note name as the key-code already stored therein. Since the delay flip-flop 197 becomes cleared in response to the "1" state of the coincidence signal LDNEQ, the KC memory 21 does not admit the corresponding set of melody-chord-note data LMKC.

It will have been seen that the delay flip-flop 197 is not cleared if each outgoing chord-ensemble-note key code LMKC represents a note within the tonal range of the upper keyboard, and if its note name differs from those of the key-code being stored in the KC memory 21. The output from the delay flip-flop 197 enters still another delay flip-flop 198 via an AND gate A35, which is enabled by the timing signal SY8, and an OR gate OR25. The delay flip-flop 198 has its output coupled to an AND gate A36, which is enabled by the inverted timing signal $\overline{SY8}$, and thence to the OR gate OR25, for holding the input signal.

The delay flip-flop 198 applies its output to the enable terminal E of the gate circuit 195 via the OR gate OR26 thereby causing the gate circuit to pass the chord-ensemble-note key code LMKC on to the KC memory 21, FIG. 11, via the OR gates 20. The output from the delay flip-flop 198 also itself travels out of the chord-ensemble-note control circuit 19 as an output signal FIL2.

The output signal FIL2 enters an AND gate A40 in the memory control circuit 23, FIG. 11, to which is also inputted the channel truncate signal TR from the truncate circuit 24, FIG. 1. The AND gate A40 puts out a "1" in timed relation to the KC memory channel specified by the channel truncate signal TR. The "1" output from the AND gate A40 is applied to the load terminal LD of the KC memory 21 via the OR gate OR29. Further, after being inverted by the NOR gate NR4, the output from the OR gate OR29 is impressed to the reset terminal CR of the KC memory 21. Thus actuated, the KC memory 21 accepts and stores the corresponding chord-ensemble-note key code LMKC as assigned to the channel indicated by the truncate signal TR.

The AND gate A40 also applies the "1" to the shift registers 221 and 222 of the DISCR memory 22 via the respective OR gates OR30 and OR31. The DISCR memory 22 stores the discrimination code "11" indicative of a chord ensemble note.

It will have been understood from the foregoing that our invention provides for the channeled storage of the chord-ensemble-note key code LMKC in the KC memory 21 in two steps, with the use of the key-on signal KO1'. The first step involves the determination of whether or not each newly created chord-ensemble-note key code LMKC represents a note falling within the tonal range of the upper keyboard. If it does, and if none of the key code already stored in the KC memory 21 represents the same note name as does the new key code LMKC, then in the second step this key code is admitted into the KC memory as assigned to an appropriate channel.

Having its output coupled to the seven-input OR gate OR34, a three-input AND gate A50 in the memory control circuit 23, FIG. 11, functions to invalidate a chord-ensemble-note key code LMKC in channeled storage in the KC memory 21 when the corresponding lower key is released, or when the corresponding key-on pulse KO1 disappears. The AND gate A50 inputs: (1) the off-note coincidence signal OFNEQ from the comparator circuit 233; (2) the key-off signal KOF from the key-off control circuit 16, FIGS. 1 and 8; and (3) the chord-ensemble-note signal LMC from the discrimination code decoder 137. Expressed as a logical formula, the terms ANDed by the gate A50 are:

OFNEQ·KOF·LMC

The AND gate A50 puts out a "1" when the key-off signal KOF becomes "1" in timewise agreement with the KC memory channel on which there is stored a chord-ensemble-note key code, and if the off-note coincidence signal OFNEQ becomes "1" at the same time. The "1" put out by the AND gate A50 passes the OR gate OR34, then is inverted, and then enters the AND gates A41 and A42 associated with the DISCR memory 22. Thus the chord-ensemble-note key code on the KC memory channel is invalidated.

A further AND gate A51, also having its output coupled to the seven-input OR gate OR34, serves the purpose of invalidating all the chord-ensemble-note key codes LMKC on the KC memory channels in the event of a change from one lowest played uk note to another. The AND gate A51 receives a lowest-note-change signal ICH* from a delay flip-flop 236 and the chord-ensemble-note signal LMC from the discrimination code decoder 137. The inputs ANDed by the gate A51 can therefore be formulated as:

ICH*·LMC

Input to the delay flip-flop 236, via an OR gate OR36, is the output from an AND gate A54 which receives the chord ensemble signal MC and the lowest-note-change signal ICH from the lowest-uk-note detector circuit 15, FIGS. 1 and 4. The output from this delay flip-flop is fed back to its input via an AND gate A55, to which there is also inputted the timing signal SY8, and the OR gate OR36. The delay flip-flop 236 functions, therefore, to stretch the 3 $\mu$s pulse duration of the lowest-note-change signal ICH into 8 $\mu$s, thus providing the output signal ICH* for delivery to the AND gate A51.

Since the melody chord signal MC becomes "1" and remains in that state upon closure of the chord ensemble selector switch 7, FIG. 1, the AND gate A51 puts out a "1" for each of the KC memory channels on which there is stored a chord-ensemble-note key code LMKC, in the event of a change from one lowest played uk note to another. The "1's" from the AND gate A51 serve to invalidate all the data sets LMKC on the KC memory channels.

A still further AND gate A52, also having its output coupled to the seven-input OR gate OR34, performs the function of invalidating the octave-below-highest-note key code MKC' and chord-ensemble-note key code LMKC on the KC memory channels when all the keys are released on the upper keyboard or when the chord ensemble selector switch 7 is turned off. The AND gate A52 inputs the output from a NAND gate NA2, which receives the chord ensemble signal MC and the uk any-key-on signal UAKO, and the output from the OR gate OR33 which receives the octave-below-highest-note signal MAX' and the chord-ensemble-note signal LMC. The terms ANDed by this gate A52 can be expressed as:

$$(\overline{MC \cdot UAKO}) \cdot (LMC + MAX')$$

Thus, when the chord ensemble signal MC or uk any-key-on signal UAKO becomes "0", the AND gate A51 puts out a "1" for each of the KC memory channels where the octave-below-highest-note signal MAX' or the chord-ensemble-note signal LMC is "1". The "1's" from the AND gate A52 serve to invalidate all the key codes MKC' and LMKC on the KC memory channels.

Figure 12:
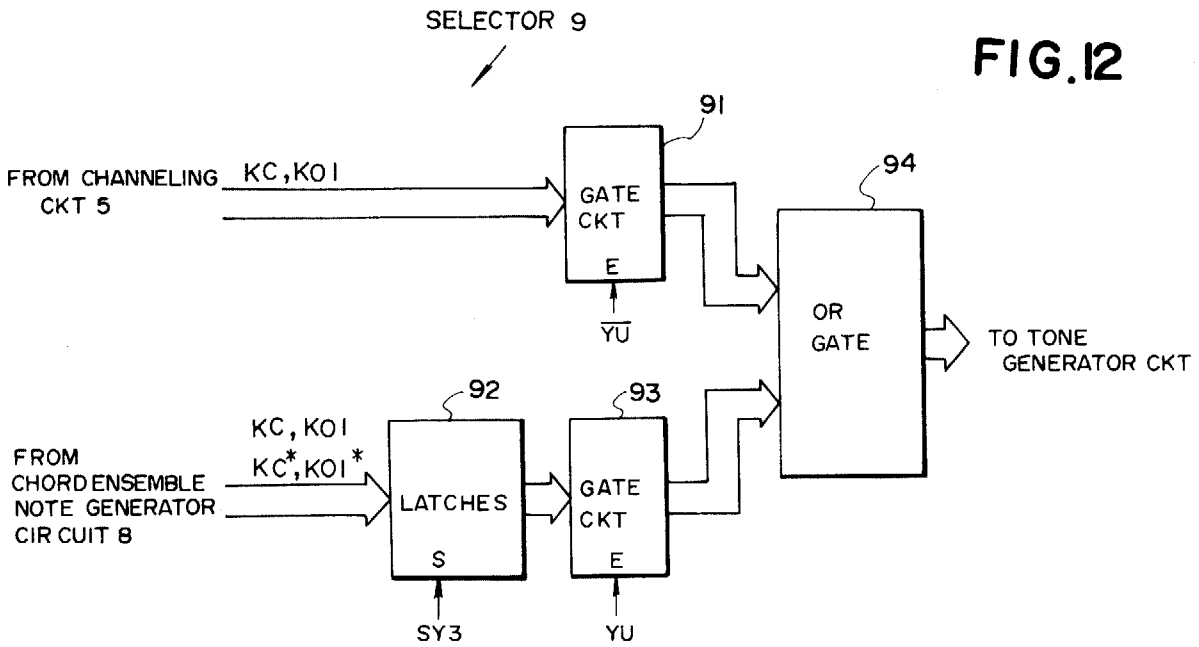
FIG. 12 is a block diagram of the selector in the instrument of FIG. 1.

FIG. 12 is a detailed, block diagrammatic illustration of the selector 9 shown in FIG. 1. The selector includes a gate circuit 91 receiving the channeled key-code KC and key-on signal KO1 from the channeling circuit 5, FIG. 1. Applied to the enable terminal E of this gate circuit 91 is the inversion $\overline{YU}$ of the upper keyboard timing signal YU seen at (E), FIG. 2. So enabled, the gate circuit 91 permits the passage therethrough of those key codes KC, and those parts of the key-on signal KO1, which have been assigned by the channeling circuit 5 to the time-divisional pedal keyboard channel P1 and lower keyboard channels L1 through L7. The pedal (hereinafter referred to as "pk") and lk key code KC and key-on signals KO1 pass from the gate circuit 91 into an OR gate network 94.

Also included in the selector 9 is a latch circuit 92 which inputs the uk key codes KC (UKC), an octave-below-highest-note key code and chord-ensemble-note key codes KC* (MCK' and LMKC), and key-on signals KO1 and KO1* associated with the data KC and KC*, from the chord ensemble note tone generator circuit 8 shown in its entirety in FIG. 1. The latch circuit 92 accepts a timing signal SY3, given at (I), FIG. 2, through its strobe terminal S. The timing signal SY3 becomes "1" during every third one of the time-divisional KC memory channels shown at (G), FIG. 2. Actuated by this timing signal SY3, the latch circuit 92 latches the incoming channeled information KC, KC*, KO1 and KO1* in the order of the third, sixth, first, fourth, seventh, second, fifth, and eighth KC memory channels, as will be understood upon inspection of (G) and (I) in FIG. 2.

The selector 9 further comprises another gate circuit 93 receiving the information KC, KC*, KO1 and KO1* from the latch circuit 92. The enable terminal E of the gate circuit 93 inputs the upper keyboard timing signal YU. Thus, as a consideration of (E), (G) and (I) in FIG. 2 will reveal, the gate circuit 93 allows the passage therethrough of only those segments of the incoming information which are assigned to the third, sixth, first, fourth, seventh, second, and fifth KC memory channels, in the order of enumeration, and blocks the information segments on the eighth channel.

The output information from the gate circuit 93 enters the OR gate network 94 and, in time-divisional relationship with the output information from the first recited gate circuit 91, passes on to the multichannel tone generator circuit 10. In coaction with the audio output system 11, FIG. 1, the tone generator circuit 10 converts the input data KC and KC* into audible sounds in a manner well known in the art.

As has been stated, we have so far described the chord ensemble note generator circuit 8, as well as the parts or components associated therewith, on the assumption that the chord ensemble selector switch 7, FIG. 1, is closed, with the consequent "1" state of the chord ensemble signal MC. When this switch 7 is open, on the other hand, the resulting "0" state of the signal MC disables the AND gate A23 in the octave-below-highest-note control signal 18, FIG. 9, the AND gate A32 in the chord ensemble note control circuit 19, FIG. 10, and the AND gate A54 in the memory control circuit 23, FIG. 11. With these AND gates A23, A32 and A54 disabled, the chord ensemble note generator circuit 8 creates neither octave-below-highest-note key code MCK' nor chord-ensemble-note data LMKC.

It is to be understood that we do not intend to limit our invention to exact details of the foregoing disclosure. For example, although we have adopted octave-below-highest-note key code and chord-ensemble-note data as instances of the "secondary key data", we recognize, of course, that our invention finds application to other types of electronic musical instruments capable of automatically generating other types of secondary key data. Further, since a variety of modifications or variations of the illustrated instrument will readily occur to one skilled in the art, it is appropriate that our invention be construed broadly and in a manner consistent with the fair meaning or proper scope of the appended claims.

What we claim is:

1. A polyphonic, keyboard-type electronic musical instrument comprising:

(a) keyboard means including keys for playing notes;

(b) means for generating in response to actuation of said keys primary key data each representative of a first note which is a note played by each of said keys;

(c) means for generating in response to actuation of said keys secondary key data each representative of a second note which is a note other than said first note and having a predetermined relationship to said first note;

(d) tone generator means having a plurality of sounding channels for simultaneous production of tones in response to said primary and the secondary key data;

(e) first memory means having a plurality of storage channels for storing said primary and the secondary key data and delivering to respective ones of said sounding channels of said tone generator means;

(f) second memory means having a plurality of storage locations, respectively corresponding to the storage channels of said first memory means, each for storing a data representing the discrimination between said primary and the secondary key data stored in each corresponding storage channel of said first memory means; and (g) control means for causing the first memory means to store in each of said storage channels the primary or the secondary key data as selected in accordance with said data stored in each storage location of said second memory means.

2. A polyphonic, keyboard-type electronic musical instrument comprising:

(a) keyboard means including keys for playing notes;

(b) means responsive to depression of said keys for generating primary key data each representing in terms of a first binary code a first note which is a note played by each of said keys;

(c) means responsive to said primary key data for generating secondary key data each representing, in terms of the first binary code, a second note which is a note having a predetermined musical relationship to said first note other than said first note;

(d) tone generator means having a plurality of sounding channels for simultaneous production of tones in response to said primary and the secondary key data;

(e) first memory means having a plurality of storage channels for storing said primary and the secondary key data and delivering to respective ones of said sounding channels of said tone generator means;

(f) second memory means having a plurality of storage locations, respectively corresponding to the storage channels of said first memory means, each for storing a data representing the discrimination between said primary and the secondary key data stored in each corresponding storage channel of said first memory means, the data stored in said second memory means being coded in terms of a second binary code; and (g) control means for causing the first memory means to store in each of said storage channels the primary key data in preference to the secondary key data being designated in accordance with said data stored in each storage location of said second memory means.

3. The instrument of claim 1 or 2, wherein the control means comprises means for invalidating, in introducing each new primary key data into the first memory means, a secondary key data, if any, which represents the same note name as the new primary key data and which has been stored in the first memory means.

4. The instrument of claim 3, wherein the invalidating means comprises:

(a) means for comparing the note name represented by each new primary key data with the note name or names represented by the secondary key data already stored in the first memory means; and (b) means for detecting that storage channel of the first memory means on which there is stored the secondary key data representative of the same note name as the new primary key data, on the bases of the output from the secondary memory means and the output from the comparing means.

5. The instrument of claim 3, wherein said control means comprises second means for invalidating, in introducting each new primary key data into the first memory means, at least one of said secondary key data, if any, which have been stored in the first memory means.

6. The instrument of claim 5, wherein said second invalidating means compirses means for detecting the storage channel or channels of the first memory means on which there are stored the secondary key data, on the basis of the output from said second memory means.

7. The instrument of claim 5, wherein the first recited and said second invalidating means invalidate the data stored on the storage channels of said first memory means by clearing the corresponding storage locations of said second memory means.

8. A polyphonic, keyboard-type electronic musical instrument comprising:

(a) first and second keyboard means each including keys for playing notes;

(b) means for generating primary key data each representative of a first note which is a note played on said first keyboard means;

(c) means for generating in response to the note played on said first keyboard secondary key data representative of notes which are of the same names as the notes played on said second keyboard means and which are in closer octaval correlation with the note played on said first keyboard means;

(d) tone generator means having a plurality of sounding channels for simultaneous production of tones in response to said primary and the secondary key data;

(e) a key data memory having a plurality of storage channels for storing said primary and the secondary key data and delivering to said tone generator means;

(f) a discrimination data memory having a plurality of storage locations, respectively corresponding to the storage channels of said key data memory, each for storing a data representing the discrimination between said the primary and the secondary key data stored in each corresponding storage channel of said key data memory; and (g) control means for causing the key data memory to store the primary or the secondary key data in each of said storage channels being selected in accordance with said data stored in each storage location of said discrimination data memory.

9. The instrument of claim 8, wherein said control means comprises:

(a) means for assigning each new primary key data to an empty storage channel, if any, of the key data memory;

(b) means for comparing the note name represented by each new primary key data to be stored in the key data memory, with the note name or names represented by the key data already stored in the key data memory;

(c) means responsive to the output from the comparing means and to the output from the discrimination data memory for invalidating a secondary key data, if any, which represents the same note name as the new primary key data and which has been stored in the key data memory;

(d) means for assigning, when the key data memory has no empty storage channel, the new primary key data to that storage channel of the key data memory on which there has been stored the secondary key data which has been invalidated by the invalidating means;

(e) means responsive to the output from the discrimination data memory for invalidating a secondary key data which has been stored in the key data memory if no secondary key data has been invalidated by the first recited invalidating means; and (f) means for assigning, when the key data memory has no empty storage channel and if no secondary key data has been invalidated by the first recited invalidating means, the new primary key data to that storage channel of the key data memory on which there has been stored the secondary key data invalidated by the second recited invalidating means.

10. The instrument of claim 8, wherein said means for generating the secondary key data comprises a representative note detector circuit for detecting a representative one of the notes played together on said first keyboard means, and wherein each secondary key data represents a note which is of the same name as each of the notes played on said second keyboard means and which is in closer octaval relation with said representative one of the notes played concurrently on said first keyboard means.

11. The instrument of claim 10, wherein said control means comprises means responsive to the output from said discrimination data memory for invalidating the secondary key data stored in said key data memory in the event of a change from one representative note to another played on said first keyboard means.

12. The instrument of claims 8, 9 or 10, wherein said control means comprises:

(a) means for comparing the note name of each key released on said second keyboard means with the note name or names represented by the key data stored in said key data memory; and (b) means responsive to the output from said comparing means recited above in this claim and to the output from said discrimination data memory for invalidating a secondary key data, if any, which represents the same note name as the key released on said second keyboard means and which has been stored in said key data memory.

13. The instrument of claim 8, 9 or 11, wherein said control means comprises:

(a) means for comparing each primary key data corresponding to a key released on the first keyboard means with the key data stored in said key data memory; and (b) means responsive to the output from said comparing means recited above in this claim and to the output from said discrimination data memory for invalidating the primary key data which corresponds to the released key and which has been stored in said key data memory.

14. The instrument of claim 8, wherein said control means comprises means responsive to the output from said discrimination data memory for invalidating the secondary key data stored in said key data memory when all the keys are released on said first keyboard means.

15. The instrument of claim 8, wherein said control means comprises:

(a) means for judging whether or not each secondary key data represents a note falling within the compass of said first keyboard means; and (b) means responsive to the output from the judging means for inhibiting the storage of the secondary key data in said key data memory if the secondary key data represents a note falling outside the compass of the first keyboard means.

16. A polyphonic, keyboard-type electronic musical instrument comprising:

(a) at least first and second keyboard means each including keys for playing notes;

(b) means for generating first primary key data each representative of a first note which is a note played on the first keyboard means, and second primary key data each representative of a second note which is a note played on the second keyboard means; p1 (c) channeling means for time-divisionally putting out the primary key data by assigning the first primary key data to first recurrent series of time-divisional channels and by assigning the second primary key data to second recurrent series of time-divisional channels;

(d) means responsive to the primary key data for generating secondary key data representative of notes having predetermined relationship to the played notes;

(e) a key data memory having a plurality of storage channels for storing a corresponding number of the first primary key data and the secondary key data;

(f) a discrimination data memory having a plurality of storage locations, corresponding to the storage channels of the key data memory, for storing data discriminating between the first primary key data and the secondary key data stored on the corresponding storage channels of the key data memory;

(g) control means responsive to the output from the discrimination data memory for causing the key data memory to store the first primary key data in preference to the secondary key data;

(h) selector means for permitting the passage therethrough of the first primary key data and the secondary key data from the key data memory during the first recurrent series of time-divisional channels and for permitting the passage therethrough of the second primary key data from the channeling means during the second recurrent series of time-divisional channels; and (i) tone generator means having a plurality of sounding channels for the production of tones in response to the data inputted from the selector means.

17. A polyphonic, keyboard-type electronic musical instrument commprising:

(a) at least first and second keyboard means each including keys for playing notes;

(b) means for generating first primary key data each representative of a first note which is a note played on the first keyboard means, and second primary key data each representative of a second note which is a note played on the second keyboard means;

(c) channeling means for time-divisionally putting out the primary key data by assigning the first primary key data to first recurrent series of time-divisional channels and by assigning the second primary key data to second recurrent series of time-divisional channels;

(d) means responsive to the first and the second primary key data for generating first secondary key data representative of notes having a first predetermined relationship to the played notes, and second secondary key data representative of notes having a second predetermined relationship to the played notes;

(e) a key data memory having a plurality of storage channels for storing a corresponding number of the first primary key data and the first and the second secondary key data;

(f) a discrimination data memory having a plurality of storage locations, corresponding to the storage channels of the key data memory, for storing data disciminating between the first primary key data and the first and the second secondary key data stored on the corresponding storage channels of the key data memory;

(g) control means responsive to the output from the discrimination data memory for causing the key data memory to store the first primary key data in preference to the first and the second secondary key data;

(h) selector means for permitting the passage therethrough of the first primary key data and the first and the second secondary key data from the key data memory during the first recurrent series of time-divisional channels and for permitting the passage therethrough of the second primary key data from the channeling means during the second recurrent series of time-divisional channels; and (i) tone generator means having a plurality of sounding channels for the production of tones in response to the data inputted from the selector means.

18. The instrument of claim 17, wherein the control means comprises:

(a) means for assigning each new first primary key data to an empty storage channel, if any, of the key data memory;

(b) means for comparing the note name represented by each new first primary key data to be stored in the key data memory, with the note name or names represented by the key data already stored in the key data memory;

(c) means responsive to the output from the comparing means and to the output from the discrimination data memory for invalidating a first secondary key data, if any, which represents the same note name as the new first primary key data and which has been stored in the key data memory;

(d) means for assigning, when the key data memory has no empty storage channel, the new first primary key data to that storage channel of the key data memory on which there has been stored the first secondary key data which has been invalidated by the invalidating means;

(e) means responsive to the output from the discrimination data memory for invalidating a first or second secondary key data which has been stored in the key data memory if no first secondary key data has been invalidated by the first recited invalidating means; and (f) means for assigning, when the key data memory has no empty storage channels and if no first secondary key data set has been invalidated by the first recited invalidating means, the new first primary key data to that storage channel of the key data memory on which there has been stored the first or second secondary key data invalidated by the second recited invalidating means.

* * * * *